US006463231B2

(12) United States Patent
Numazu et al.

(10) Patent No.: US 6,463,231 B2
(45) Date of Patent: Oct. 8, 2002

(54) PRINTER DEVICE

(75) Inventors: Toshihiko Numazu, Sayama; Shigeru Hirosawa, Fussa; Tetsushi Kurokawa; Kazuhiro Kameyama, both of Tokyo; Noriki Ono; Yasuhiro Tsuyuki, both of Higashiyamato; Seiji Tachibana, Hamura; Eiichi Nara, Fussa, all of (JP)

(73) Assignees: Casio Computer Co., Ltd., Tokyo (JP); Casio Electronics Manufacturing Co., Ltd., Iruma (JP)

( * ) Notice: Subject to any disclaimer, the term of this patent is extended or adjusted under 35 U.S.C. 154(b) by 0 days.

(21) Appl. No.: 09/745,046

(22) Filed: Dec. 20, 2000

(30) Foreign Application Priority Data

| | | |
|---|---|---|
| Dec. 22, 1999 | (JP) | 11-365621 |
| Jan. 25, 2000 | (JP) | 2000-015782 |
| Jan. 26, 2000 | (JP) | 2000-016904 |
| Oct. 31, 2000 | (JP) | 2000-333787 |
| Dec. 1, 2000 | (JP) | 2000-366756 |

(51) Int. Cl.[7] ..... G03G 15/00
(52) U.S. Cl. ..... 399/110
(58) Field of Search ..... 399/110, 107, 399/126, 124, 116

(56) References Cited

U.S. PATENT DOCUMENTS 5,245,357 A * 9/1993 Maruyama et al. ..... 399/113 X
6,108,514 A * 8/2000 Nakayama et al. ..... 399/400

FOREIGN PATENT DOCUMENTS

JP 2-93670 * 4/1990

* cited by examiner

*Primary Examiner*—Quana M. Grainger
(74) *Attorney, Agent, or Firm*—Frishauf, Holtz, Goodman & Chick, P.C.

(57) ABSTRACT

An upper body which can be shifted from and toward a lower body through a link mechanism is formed. A drum unit and a toner unit are arranged on the side of the upper body. The upper body is opened in the parallel with respect to the lower body with a predetermined interval, by the link mechanism including arms. In the state where the upper body is opened, the drum unit and the toner unit can be detached from and attached to the printer device in frontward and backward directions, by sliding a sliding member arranged on the upper body.

16 Claims, 22 Drawing Sheets

PRINTER DEVICE

BACKGROUND OF THE INVENTION

1. Field of the Invention

The present invention relates to a printer device which includes image formation means, a lower body and an upper body which is shifted upward with respect to the lower body so as to be opened, and more particularly, to a tandem-type color printer device including a plurality of image formation units which are detachable from and attachable to the printer device.

2. Description of the Related Art

Conventionally, a well-known printer device includes at least one image formation unit which is detachable from and attachable to the printer device, a lower body and an upper body which is lifted upward with respect to the lower body for the maintenance sake.

FIG. 21 shows an outside perspective view of a conventional monochrome printer device (image formation device). In the illustration, a printer device 1 comprises a roof 2, which forms an upper body, and a lower body 3. The roof 2 includes a paper outputting section 5 from which a paper is output onto the roof 2, and a paper outputting tray 6 for outputting papers one on top of another. The lower body 3 includes a front cover 7 which can be opened and closed in the front section of the lower body 2, and a paper cassette 8 which is detachable from and attachable to the lower body 3. An MPF (Multi Paper Feeder) tray 9 which can be contained in the lower body 3 is arranged on the right side of the printer device 1. An operational display section 4 for inputting information to the printer device 1 or for displaying the state of printer device 1 is arranged on the right upper side of the printer device 1.

In such a printer device 1, the roof 2 is opened in a direction shown with an arrow B centrically at a rotational axis A, when clearing a jam occurring in the printer device or carrying out a maintenance operation. FIG. 22 shows a cross sectional view of the printer device together with the internal structure thereof. As illustrated in FIG. 22, the printer device 1 comprises: a paper cassette 8 which is detachable from and attachable to the printer device 1; a paper feeding roller 12 which sequentially feeds papers contained in the paper cassette 8; a pair of suspension rollers 13 which suspend a received paper and send the paper to an image formation section 11 at a predetermined timing, in association with a pair of paper outputting rollers 18; a fixation unit 14 which fixes a toner image onto a paper; the pair of paper outputting rollers 18 (a driving roller 18*a* and a driven roller 18*b*) which output the paper onto which the toner image is fixed; and an operational display section 4 for performing various settings for the printer device 1 or displaying the state of the printer device 1.

In the image formation section 11, a charger 25 uniformly charges electric charges onto the circumferential surface of a photosensitive drum 23. A printing head 26 selectively exposes the circumferential surface of the photosensitive drum 23 based on printing data The electric potential of a portion of the photosensitive drum 23, whose circumferential surface is exposed, is lower than that which is charged with electricity. Hence, an electrostatic latent image is formed on the circumferential surface of the photosensitive drum 23. A developing unit 27 transfers internally contained toner onto the low potential section of the photosensitive drum 23 through a developing roller 27*a* so as to develop the electrostatic latent image. A transfer unit 28 transfers the toner image on the photosensitive drum 23 onto a paper to be conveyed, with an electric field whose polarity is opposite to that of the toner.

The photosensitive drum 23, the charger 25, the developing unit 27, the transfer unit 28, a cleaner 24, etc. which are included in the image formation section 11 are included in the lower body 3, while the printing head 26 is arranged on the roof 2 as the upper body.

The roof 2 can be opened and closed centrically about a hinge section 15 in both directions as shown with arrows B and B'. At this time, the printing head 26 and the driven roller 18*b* are incorporated with the roof 2 so as to be opened and closed altogether. The roof 2 shown with a straight line in FIG. 22 is in the state where it is closed, while the roof 2 shown with a broken line is in the state where it is opened. To keep the roof 2 opened, a body locking mechanism 16 is arranged. The body locking mechanism 16 is composed of a hook 17*a* arranged on the lower body 3 and an engagement section 17*b* which is arranged on the roof 2 and engaged with the hook 17*a*.

The image formation section 11 mainly forms a cartridge CT as an image formation unit which is detachable from and attachable to the lower body 3. The cartridge CT includes the first cartridge CT1 comprising the photosensitive drum 23 and the cleaner 24, etc, and the second cartridge CT2 including the developing unit 27. The cartridge CT is dividable into the cartridges CT1 and CT2. In the state where the roof 2 is opened, the cartridges CT1 and CT2 can be detached from and attached to a predetermined installation section of the lower body 3. If a photosensitive drum 23 is deteriorated or if toner ran out, for example, the cartridge CT1 or CT2 can be replaced with a new cartridge, or other expendable supplies can be provided as needed, thus achieving the machine maintenance operation of the printer device.

In recent years, color printer devices (color image formation devices) are widely used, and various color printing methods are employed. For example, according to one technique, a plurality of developing units are arranged adjacent to the circumferential surface of one photosensitive drum, and toner images are sequentially formed on the surface of the drum (technique (I)). There is another technique (II), which employs an intermediate transcription medium in a drum-like form. A plurality of image formation units are arranged in a predetermined direction, and toner images are sequentially output on one top of another on a paper so as to form an image (what is so-called a tandem-type printing technique).

In the above technique (I), it is necessary to use a large-sized photosensitive drum, and it is difficult to form an image formation section in one unit, resulting in low printing performance. In the above technique (II), because the intermediate transcription medium is used, the size of the printer device itself is formed large.

It is demanded that tandem-type color printer devices with an excellent shape can perform high-speed printing. In this type of printer device, image formation units of, for example, yellow (Y), magenta (M), cyan (C), and black (K) are used. Such image formation units are articles of consumption which are to be used up, thus need to be replaced with new ones periodically.

In the printer devices having the structure shown in FIGS. 21 and 22, the image formation unit is formed in the lower body 3. If the structure is employed in a tandem-type color printer device, the image formation units of yellow (Y), magenta (M), cyan (C), black (K) are sequentially arranged in the lower body 3. Hence, in the case of a maintenance operation, after the roof 2 is once opened, each of the image formation units needs to be taken out upward.

In the above-described conventional image formation device, even when only the first cartridge CT1 (note: the first cartridge CT1 lasts for a different time period from that of the second cartridge CT2) forming the image formation unit (cartridge CT), the cartridge CT (in the state where the cartridges CT1 and CT2 are incorporated together) is taken out from the printer device. The cartridge CT is divided into the cartridges CT1 and CT2. Then, a new cartridge CT1 is incorporated with the cartridge CT2, thereby forming a new cartridge CT. After this, the cartridge CT needs to be installed in the printer device.

Especially, in a tandem-type color printer device, toners of, for example, yellow (Y), magenta (M), cyan (C), black (K) are used. Cartridges CT1 and CT2 are necessarily prepared for each of the colors, thus requiring frequent operations for replacing the cartridges CT1 and CT2 with new cartridges. In addition, in the conventional printer devices, the cartridges CT1 and CT2 are taken out upward as described above, and new cartridges CT1 and CT2 are set in predetermined positions in the printer device.

Since the cartridges CT1 and CT2 are detachable from and attached to the lower body 3, the cartridges CT1 and CT2 are once taken out, when to carry out a process for clearing a paper jamming occurring in a paper conveyer path formed underneath the cartridges CT1 and CT2. When the upper body is opened, if a paper jamming occurs somewhere quite far from a rotational axis A, the jamming is easily cleared because the upper body and the lower body are sufficiently separated at a distance. On the contrary, if a paper jamming occurs somewhere adjacent to the rotational axis A, it is difficult to clear the jamming because the upper and lower bodies are not sufficiently separated.

Under the consideration of the above problems, the cartridges may be arranged on the side of the upper body. In the conventional printer device, the roof 2 is opened centrically about the rotational axis A, in other words, the roof 2 is opened about one end thereof as a fulcrum. Hence, it would not have mattered so much for monochrome printer devices, but for tandem-type color printer devices, a mechanical deterioration occurs because of the heavy weight of the upper body. This causes positional deviations of the image formation units and difficulty in stabilizing printing performance. Because the upper body is opened about the one end thereof as a fulcrum, the image formation unit is so difficult to be detached from and attached to the printer device.

In tandem-type image formation devices, the plurality of image formation units are used as described above. Hence, when the image formation units are driven, they need to completely be locked. Besides, the locking of the image formation units needs to be improved as should be performed with ease.

Furthermore, in the above conventional printer device, the roof 2 rotates upward during the maintenance operation, the operational display section 4 can not be arranged on the roof 2 (if the operational display section 4 is arranged on the roof 2, the operator of the printer device can not reasonably see the display section), thus is arranged on the lower body 3. In this structure, therefore, the printer device can not freely be designed. Besides, the operational display section 4 projects as shown in FIG. 21, is an obstacle on the way to utilization of the printer device, and results in a large size of the printer device entirely.

SUMMARY OF THE INVENTION

The present invention has been made in consideration of the above. It is accordingly an object of the present invention to provide a printer device, which can realize high quality printing, includes a newly-designed link mechanism for shifting an upper body approximately in parallel with respect to a lower body, and a plurality of image formation units on the upper body, and can retain the maintenance operation without having any mechanical deterioration.

Another object thereof is to provide a printer device which includes cartridges sliding in both forward and backward directions so as to be detached from and attached to the printer device, and wherein each of image formation units can be replaced with new units easily.

Still another object thereof is to provide a printer device wherein a plurality of image formation units can synchronously be locked with an easy operation.

Yet still another object thereof is to provide a printer device wherein an operational display section can be seen even when an upper body is opened, and which is improved in machine operations.

In order to achieve the above objects, there is provided a printer device, which includes a paper conveyer path and image formation means for forming an image on a paper conveyed along the paper conveyer path, and is dividable into an upper body and a lower body, the printer device comprising a body linking mechanism for opening the upper body with a predetermined interval between the lower body, and connecting the upper body and the lower body, and wherein a posture of the upper body with respect to the lower body is retained, by the body linking mechanism, approximately same as a posture of the upper body which is closed, when opening the upper body upward with respect to the lower body, and the upper body is shifted in directions except in a forward direction.

In thus structured printer device according to the present invention, the printer device is divided into the upper body and lower body, by opening the upper body. The image formation means may include image formation units for colors of magenta (M), cyan (C), yellow (Y) and black (K) which are sequentially arranged in a predetermined direction. Each of the image formation units is formed of a drum unit including a charger, a photosensitive drum, etc., and a toner unit containing a developing roller, toner, etc. Each of the image formation units including the drum unit and the toner unit can be arranged on the upper body. If the upper body is shifted upward so as to be opened, the paper conveyer path is opened. In this structure, a process for clearing any jams occurring in the printer device can be carried out, and the drum unit or toner unit can be pulled out so as to be replaced with new one. That is, the maintenance operations of the printer device can be carried out easily. The drum and toner units for the above respective colors are set on the same upper body, thus improving the positioning accuracy in image printing with high quality printing performance.

In the printer device, the body linking mechanism includes:

a pair of first arms each of which has a rotational fulcrum at a central section of either one side surface of the lower body;

a pair of second arms each of which has a rotational fulcrum at an outer section of either one side surface of the lower body; and a pair of link members which are arranged on respective side surfaces of the upper body, and rotatively and oppositely connected to corresponding ones of the respective first and second arms.

According to the above structure, with the link mechanism, the upper body can be shifted upward approximately in parallel with respect to the lower body. In addition, the upper body can smoothly and stably be opened or closed. Besides, the upper body is shifted approximately in parallel with respect to the lower body, thus the operational display section can be arranged on the upper body, for example.

In the printer device, the body linking mechanism further includes:

a first and second rotational members each of which has a rotational fulcrum which coincides with the corresponding rotational fulcrum of the first and second arms, and which are rotated along with rotations of the first and second arms; and driving transmission members which are arranged between the first and second rotational members and transmit, to the first and second rotational members, a driving force for forcing the first and second arms to rotate centrically at their rotational fulcrums.

The driving transmission member is a rotational transmission member, such as a belt or the like. According to this structure, the rotation between the first arm and the second arm is processed in association with the driving transmission member, and the upper body is smoothly shifted upward and downward.

In the printer device, a length of the first arm is larger than a length of the second arm; and a position of the rotational fulcrum of the first arm is higher than a position of the rotational fulcrum of the second arm.

According to this structure, the length of the first arm differs from the length of the second arm. Hence, the interval between the upper body and the lower body can appropriately be set, and the upper body lifted upward can be adjusted to have an appropriate distance from the lower body.

In the printer device, the body linking mechanism includes a link member for linking the upper body with the lower body; and the link member includes a damper which controls a rotational speed of the upper body, when the upper body is rotated so as to be closed, and which does not operate when the upper body is rotated so as to be opened.

According to this structure, when opening the upper body, the upper body can smoothly be opened while controlling a sudden fall of the upper body according to the law of gravitation. This prevents any shock in the printer device, secures the positioning accuracy in the image printing, and prevents breakdown of the printer device.

The printer device further includes additional tension providing means for providing additional tension for forcing the upper body to be shifted upward with respect to the lower body in such a direction that the upper body is opened; and body locking means for retaining the upper body in a position where the upper body is closed.

The additional tension forcing means is an elastic body such as a spring, etc. The body locking means is means fixed on the upper body, such as a hook, etc. According to this structure, the opening of the upper body can be achieved only with very light force, facilitating the machine maintenance operations.

In the printer device, the image formation means is formed of a plurality of members incorporated with each other, and includes at least one image formation unit, which is detachable from and attachable to the upper body. According to this structure, when the upper body is opened, the image formation unit is also lifted up. The image formation unit is pulled out so as to be easily detached from the upper body. Because the drum unit and the toner unit are formed independently, they can be replaced separately. It is especially be effective if the image formation unit is formed of a drum unit and a toner unit both having different periods of life.

In the printer device, the image formation unit is formed of a drum unit, having a photosensitive drum, and a toner unit, having a developing roller;

the drum unit and the toner unit are formed at a predetermined interval in a state where the upper body is opened, and formed in such a way that the photosensitive drum and the developing roller are pressure-welded in a state where the upper body is closed.

According to this structure, the upper body can smoothly be opened and closed. The drum unit and the toner unit can be detached from and attached to the upper body which is shifted upward in parallel with respect to the lower body.

In the printer device according to the present invention, the image formation unit includes a plurality of image formation units arranged along the paper conveyer path, thereby to realize a tandem-type printer device. The plurality of image formation units are prepared for colors of magenta (M), cyan (C), yellow (Y) and black (K), and arranged in a sequential order.

In the printer device, each of the plurality of image formation units includes a position determination shaft;

a plurality of shaft receivers, which are adjacent to the position determination shafts of the respective image formation units, are arranged in the lower body, when the upper body shifted back to the lower body so as to be closed; and each of the plurality of shaft receivers has a shaft locking mechanism so as to be locked by an operation of a single lever.

According to this structure, the position determination axes are easily locked. When the upper body is shifted back toward the lower body, the image formation units are securely locked as well.

The shaft locking mechanism:

includes a rotator which rotates along with the operation of the lever, and a rotational member which changes a level of a rotational force of the rotator to a level of a driving force of the shaft receivers; and drives the shaft receivers with the driving force changed by the rotational member, and controls the position determination shafts to lock the shaft receivers, respectively. According to this structure, the plurality of position determination axes are synchronously locked with the shaft locking mechanism by manipulating the lever.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

A preferred embodiment and a modification of the present invention will now be explained with reference to the accompanying drawings.

Figure 1:
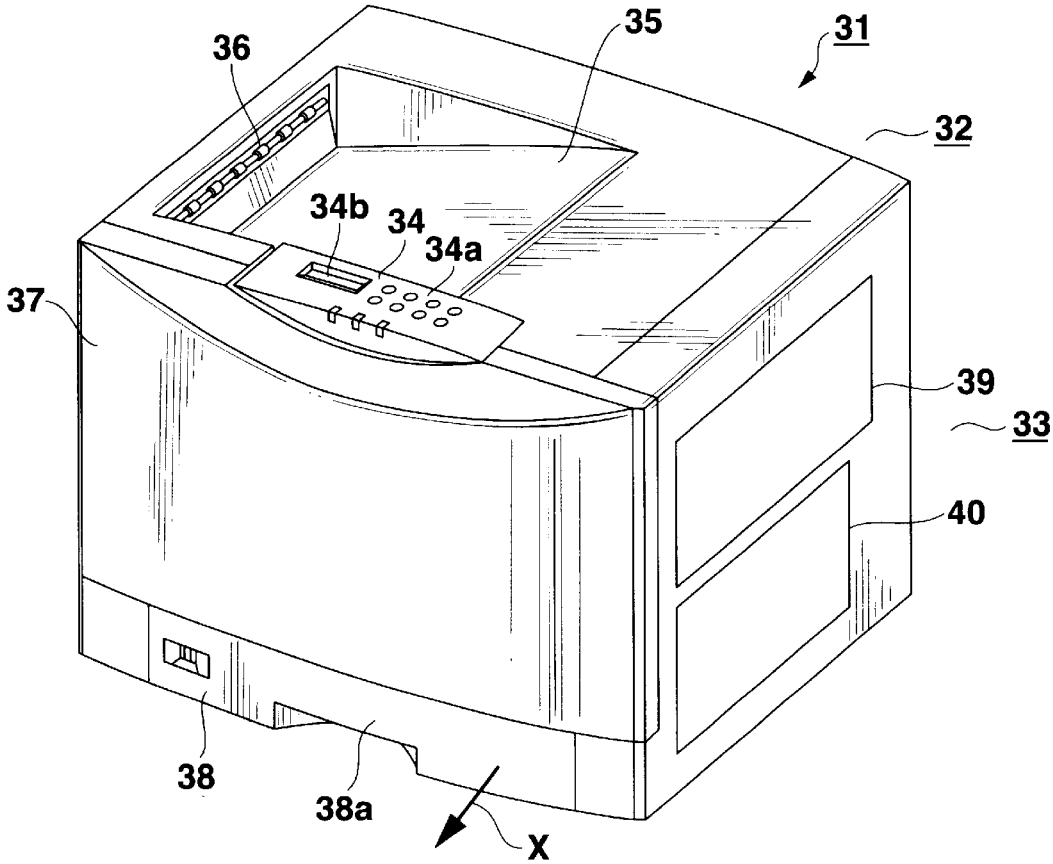
FIG. 1 is an outside perspective view of a printer device, according to one embodiment of this invention, what is so-called a tandem-type color printer device.

FIG. 1 exemplifies a printer device of this embodiment, what is called a tandem-type color printer device. The printer device of this embodiment is a printer device for both-side printing. In the illustration, a printer device 31 is connected to a host apparatus, such as a personal computer or the like through a non-illustrative cable.

The printer device 31 comprises an upper body 32 and a lower body 33. The upper body 32 includes an operational panel 34 and an output tray 35 for printing papers which is arranged on the surface of the upper body 32. The operational panel 34 comprises a key operational section 34*a* including a plurality of keys, and a liquid crystal display 34*b* for displaying information which is output under the control of a non-illustrative CPU. The output tray 35 accepts output papers, on which image data is printed by later-described image formation units, which are transported by the rotation of a paper outputting roller 36. Papers are subsequently output onto the output tray 35 one on top of another.

The lower body 33 includes a conveyer unit for both-side printing, as will be explained later, and a feeding cassette 38 which are installed in the lower body 33. After a non-illustrative lid arranged on the side surface of the printer device 31 is opened, for example, the conveyer unit can be detached from and attached to the lower body 33. The lower body 33 includes a front cover 37 which can be opened and closed in front of the lower body 33, and the feeding cassette 38 which are detachable from and attachable to the lower body 33. The front cover 37 is opened, while clearing any jams occurring in the printer device 31 or during the machine maintenance.

Arranged on the right-side surface of the lower body 33 are an installation section 39 for an MPF (Multi-Paper Feeder) tray and a cover 40. FIG. 1 shows the state of the printer device 31 in which the MPF tray is not installed in the installation section 39. he cover 40 is one prepared for checking a paper conveyer path, and is opened so as to carry out a maintenance operation for clearing a jam caused by a paper stacked somewhere inside the printer device 31.

Figure 2:
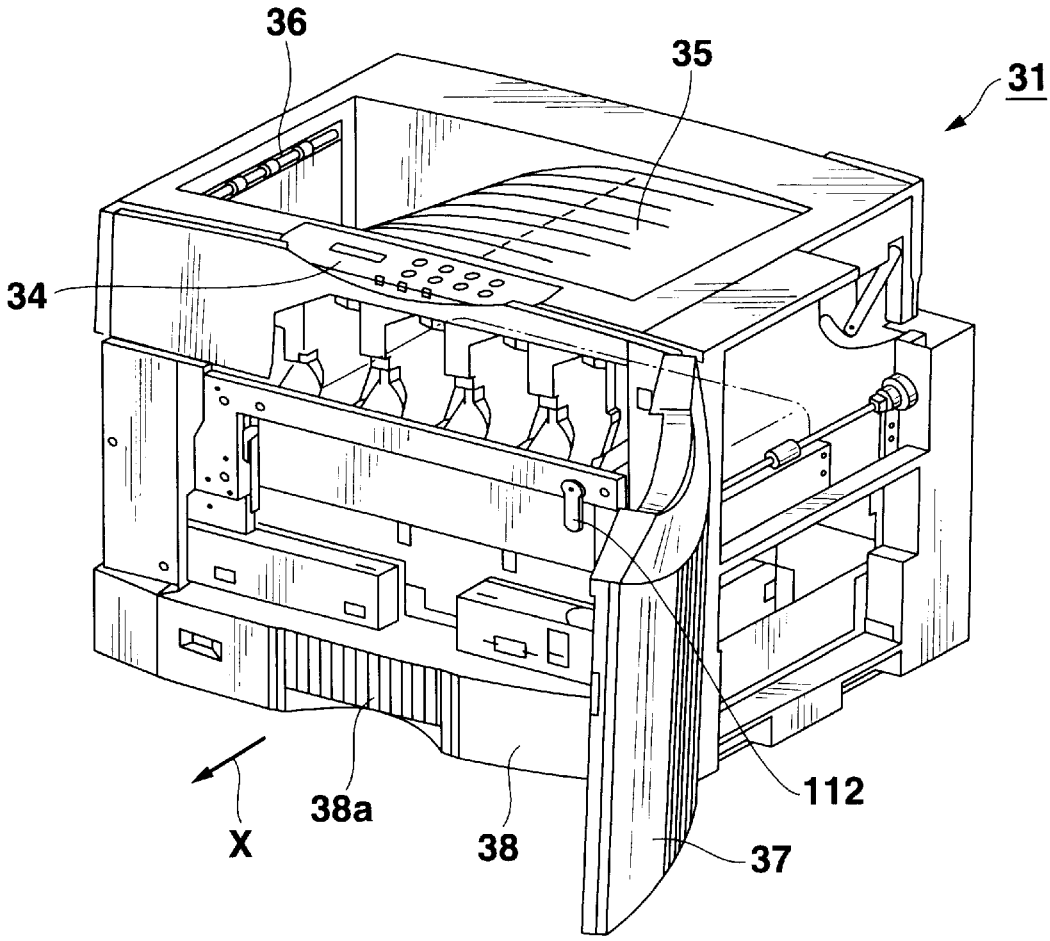
FIG. 2 is an outside perspective view showing a state of the printer device, according to the one embodiment of this invention, wherein a front cover or the like is opened.

FIG. 2 is an outside perspective view of the printer device 31 of this embodiment, and shows a state in which the front cover 37 and the cover 40 are both opened. The feeding cassette 38 is included in the most lower stage of the printer device 31. When providing the feeding cassette 38 with paper, a knob 38 is pulled out, for example, thereby the feeding cassette 38 can be pulled out in an X-direction.

Figure 3:
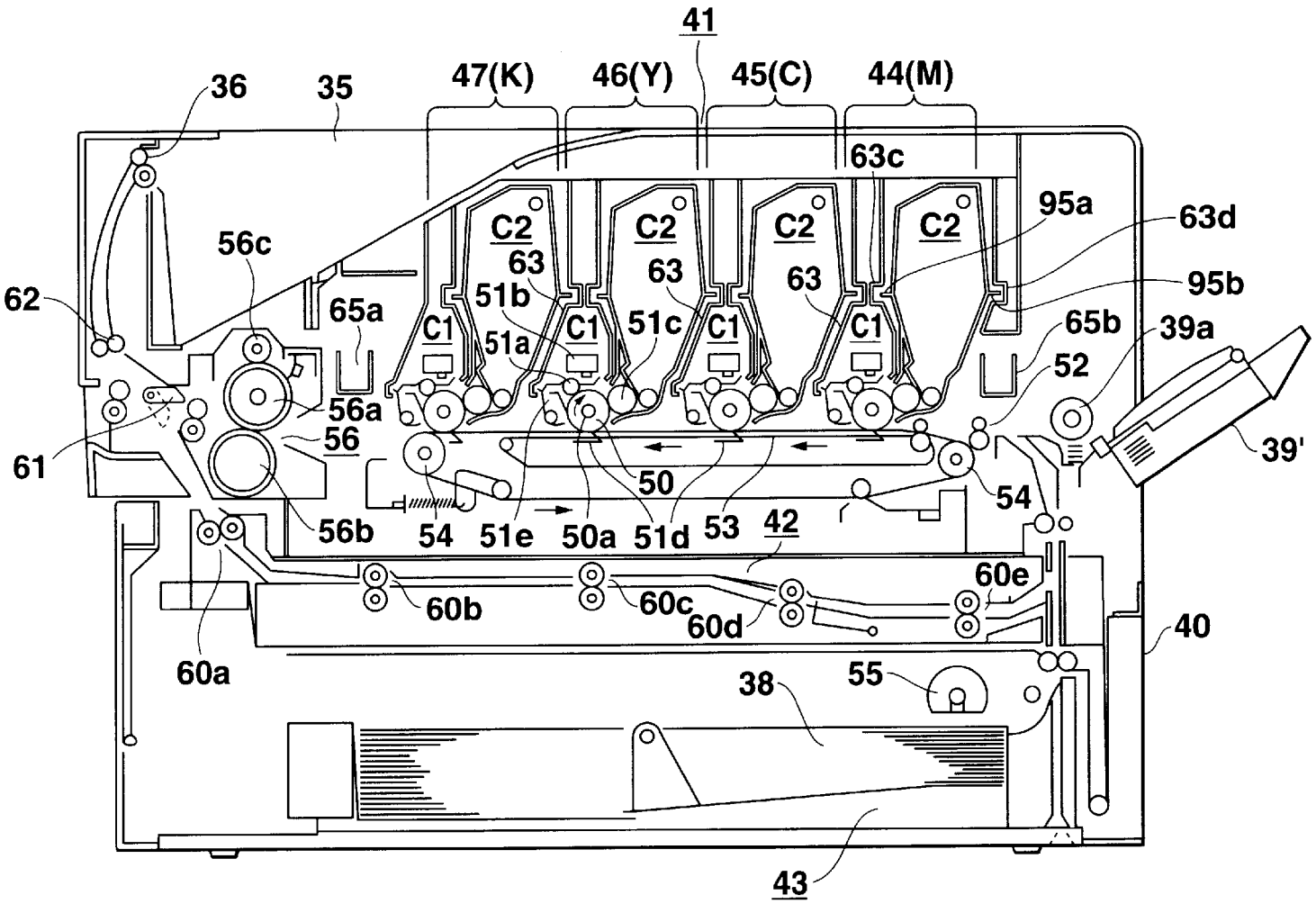
FIG. 3 is an exemplary cross sectional view showing the internal structure of the printer device according to the one embodiment of this invention.

FIG. 3 is an exemplary cross sectional view for explaining the internal structure of the printer device 31 having the so-far described appearance. In the illustration, the printer device 31 comprises an image formation section 41, a conveyer unit 42 for both-side printing, and a paper feeding section 43, and the like. The image formation section 41 includes four image formation units 44 to 47 along the paper conveyer path. Those image formation units 44 to 47 include units for respective colors of magenta (M), cyan (C), yellow (Y) and black (K) sequentially in a direction from the right side to the left side of the printer device 31 in the illustration. The image formation units 44 to 46 for colors of (M), (C) and (Y) are prepared for color printing with subtractive mixture of colors. The image formation unit 47 for (K) is prepared for monochrome printing.

Each of the image formation units 44 to 47 includes a drum unit C1 and a toner unit C2. Each of the image formation units 44 to 47 has the same structure as each other, except the color of toner in the toner unit C2. Hence, in this embodiment, explanations will be made to the image formation unit 46 for (Y) by way of example. The drum unit C1 includes a photosensitive drum, a charger, and a cleaner. The toner unit C2 includes a developing roller, a toner, etc. The circumferential surface of the photosensitive drum 50 is formed of an organic optical-conductive material, for example. A charger 51*a*, a printing head 51*b*, a developing roller 51*c*, a transcription unit 51*d*, and a cleaner 51*e* are arranged adjacent to the photosensitive drum 50. The photosensitive drum 50 rotates in a direction as shown with an arrow (in a clockwise direction in the illustration). The circumferential surface of the photosensitive drum 50 is uniformly charged with an electric charge from the charger 51*a*. An electrostatic latent image is formed on the circumferential surface of the photosensitive drum 50 by optical writing based on printing information from the printing head 51*b*, thereby to form a toner image by the developing roller 51*c*. At this time, the toner image formed on the circumferential surface of the photosensitive drum 50 is formed with a toner of yellow (Y) contained in the image formation unit 46. The toner image thus formed on the circumferential surface of the photosensitive drum 50 reaches the transcription unit 51*d* along with the rotation of the photosensitive drum 50, and is transcribed onto a paper which is conveyed in accordance with a direction, shown with an arrow in the illustration, immediately blow the photosensitive drum 50.

The drum units C1 and the toner units C2 of the image formation units 44 to 47 are detachable from and attachable to their corresponding units. This can be done with a unit installation section 63 which is included in each of the image formation units 44 to 47. The unit installation section 63 is formed in such a rail-like shape that its corresponding drum unit C1 and toner unit C2 slide approximately in an horizontal direction and are detached from and attached to the unit. The printing head 51*b* is arranged inside the unit installation section 63.

A drum shaft 50*a* is prepared as a position determination shaft in the photosensitive drum 50 forming a part of the drum unit C1. When the drum unit C1 included in the upper body 32 is set to the lower body 33 (refer to FIG. 13), the drum shaft 50*a* is locked by a shaft receiver, as will be explained later. The image formation units (drum units C1) are synchronously locked by their corresponding shaft receivers, respectively.

A printing paper is conveyed from the feeding cassette 38 included in the feeding section 43, throughout a suspension roller 52, a conveyer belt 53, a driving roller 54 and a driven roller 54'. The paper conveyed from the feeding cassette 38 by the rotation of a feeding roller 55 is sent to the suspension roller 52 and further onto the conveyer belt 53 at an appropriate timing the toner image reaches the paper, and reaches the transcription unit 51*d*. The toner image is transcribed onto a paper by the transcription unit 51*d*. The paper onto which the toner image is transcribed is conveyed on the conveyer belt 53 in the arrow direction (from the right side toward the left side in the illustration), in accordance with the movement of the conveyer belt 53. Heat fixation treatment is performed for thus conveyed paper by a fixation unit 56 which is prepared as heat fixation means.

On the paper, not only the toner image of yellow (Y), but also toner images of other colors of magenta (M) and cyan (C), which are transcribed by their corresponding drum units C1 and toner units C2, are transcribed, thereby to accomplish color printing based on the subtraction mixture of colors.

Not only those papers conveyed from the feeding cassette 38, but also any paper supplied from an MPF tray 39' can be used. In this case, the paper supplied from the MPF tray 39' is conveyed by a feeding roller 39*a*, and the printing is performed according to the above process.

The fixation unit 56 comprises a heat roller 56*a*, a press roller 56*b*, and a cleaning roller 56*c*. A paper P is sandwiched between the heat roller 56*a* and the press roller 56*b* so as to be conveyed. During this time, the toner image having a plurality of colors and transcribed on the paper melts and is fixed on the paper P with heat. The cleaning roller 56*c* has a function for applying oil onto the heat roller 56*a* and a function for removing toner remaining on the heat roller 56*a*. The paper, onto which the toner image is fixed by the fixation unit 56 is conveyed upward or in a leftward direction in the illustration via a switching plate 61.

The conveyer unit 42 for both-side printing is detachable from and attachable to the printer device 31, and installed in the printer device 31 when to perform both-side printing. The conveyer unit 42 for both-side printing includes a plurality of conveyer rollers 60*a*, 60*b*, 60*c*, 60*d*, and 60*e*. In the case of both-side printing, the paper is once conveyed upward by the switching plate 61. Then, when the last end of the paper reaches a conveyer roller 62, for example, the paper is suspended, and is conveyed in the reverse direction. Under this control, the paper is conveyed in a downward direction by the switching plate 61, which is set in the position shown with a broken line in FIG. 3. Then, the paper is sent to the paper conveyer path of the conveyer unit 42 for both-side printing, and conveyed through the conveyer rollers 60*a* to 60*e* so as to reach the suspension roller 52. After this, the paper is sent to the transcription unit 51*d* at a timing the toner image reaches the paper, so that the toner image is transcribed onto the back surface of the paper.

Figure 4:
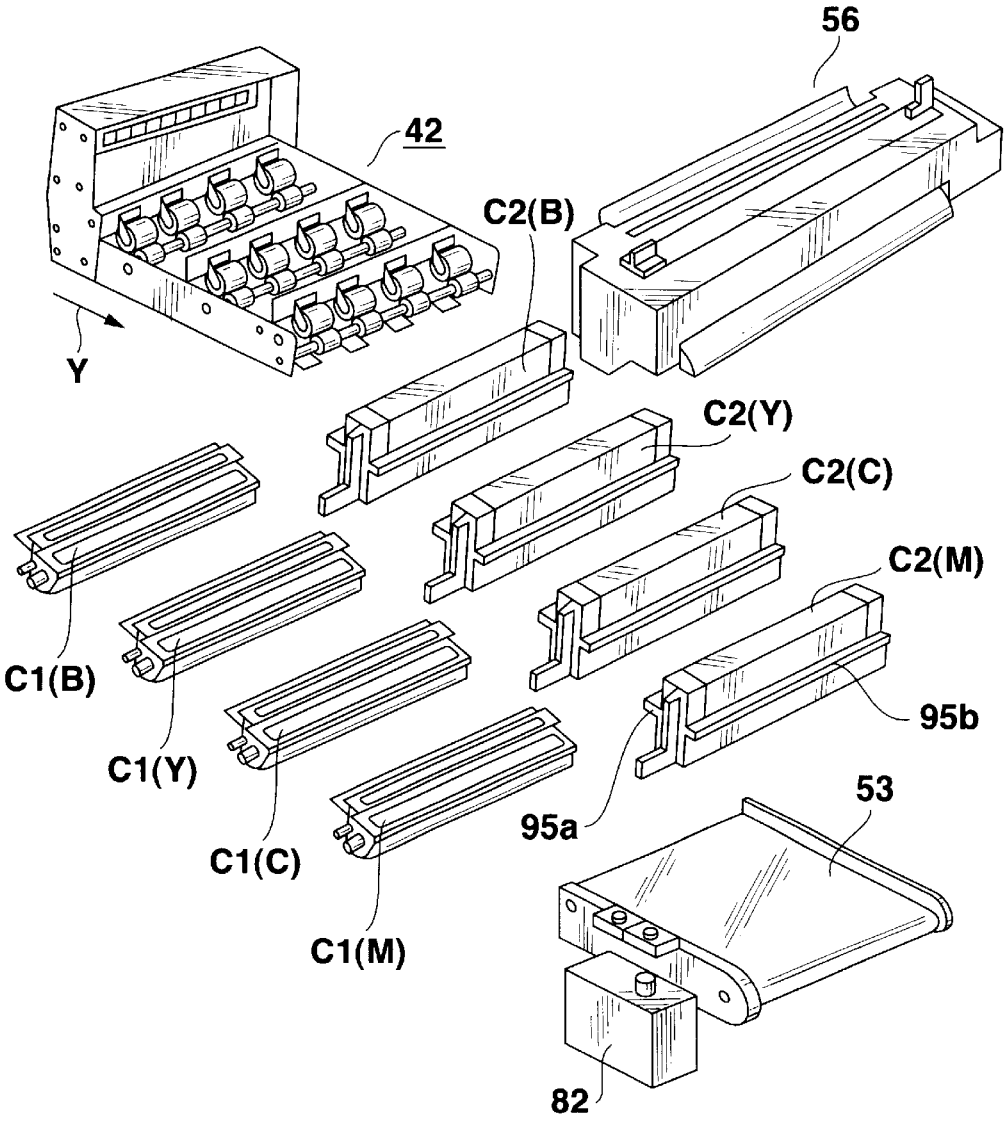
FIG. 4 is a perspective view for explaining some unit components which are employed in the printer device according to the one embodiment of this invention.

FIG. 4 is a diagram for explaining the component structure of the principal components included in the printer device 31, except a link mechanism, as will be explained later. In the illustration, the conveyer unit 42 for both-side printing are detachable from and attachable to the printer device 31. Particularly, the conveyer unit 42 for both-side printing is installed in the printer device 31 in a Y-direction in FIG. 4. A plurality of drum units C1 for colors of magenta (M), cyan (C), yellow (Y) and black (K) are provided. A plurality of toner units C2 for colors of magenta (M), cyan (C), yellow (Y) and black (K) are provided.

A cleaner bottle 82 is arranged adjacent to the paper conveyer belt 53, which is formed on the lower section (lower sections of the drum units C1 and toner units C2) of the image formation units. The cleaner bottle 82 collects a toner, etc. on the paper conveyer belt 53, removed by a non-illustrative cleaner. The fixation unit 56 is a unit which are detachable from and attachable to the printer device 31.

The link mechanism 64 (refer to FIG. 5) of the printer device 31 is one for opening/closing the upper body 32 approximately in parallel with respect to the lower body 33. In FIG. 3, only the positions of FR frames 65*a* and 65*b* which are the part of the link mechanism 64 are shown. Those FR frames 65*a* and 65*b* are arranged inside the printer device 31, respectively on the right and left sides of the printer device. Particularly, the FR frame 65*a* is arranged adjacent to the fixation unit 56 as a heat source.

In the printer device 31 of this embodiment, the upper body 32 is opened approximately in parallel with respect to the lower body 33, when to carry out a maintenance operation for the printer device.

Figure 5:
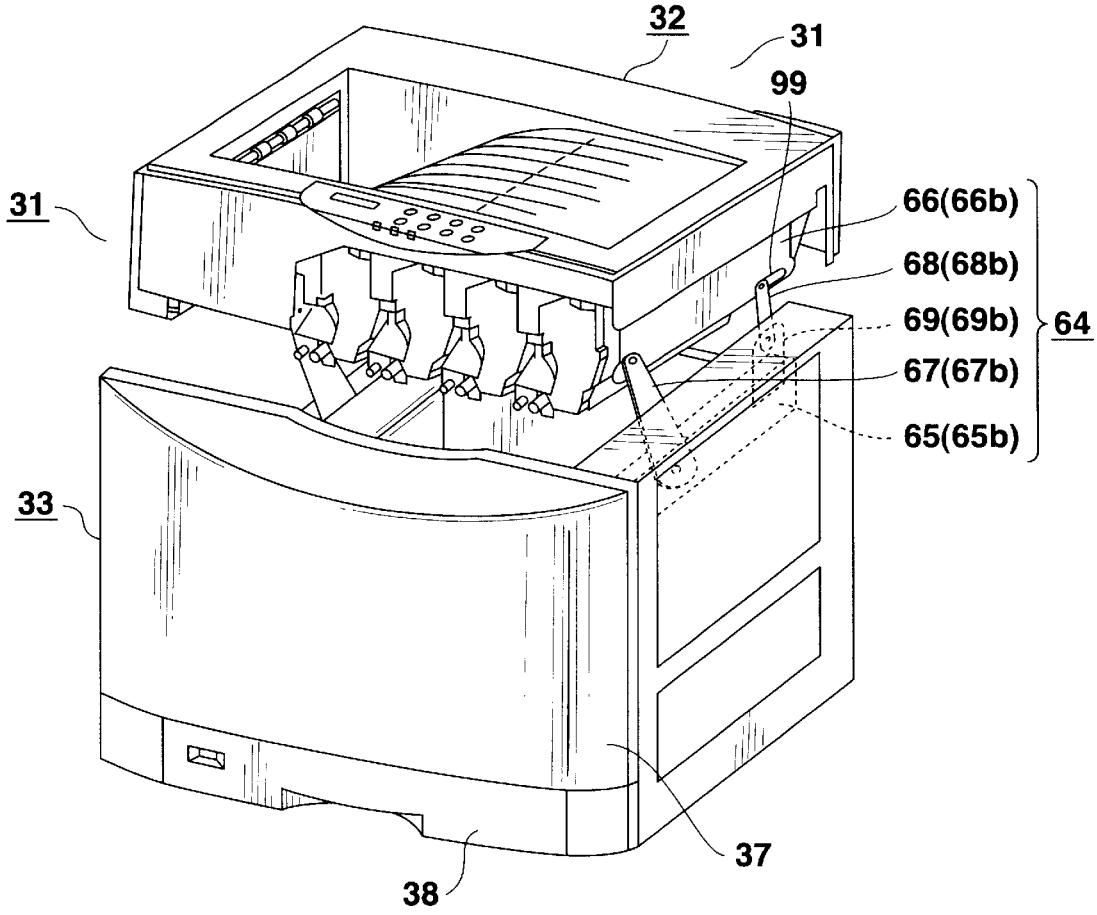
FIG. 5 is an outside perspective view for explaining a state of the printer device, according to the one embodiment of this invention, wherein an upper body is opened with a link mechanism.
Figure 18:
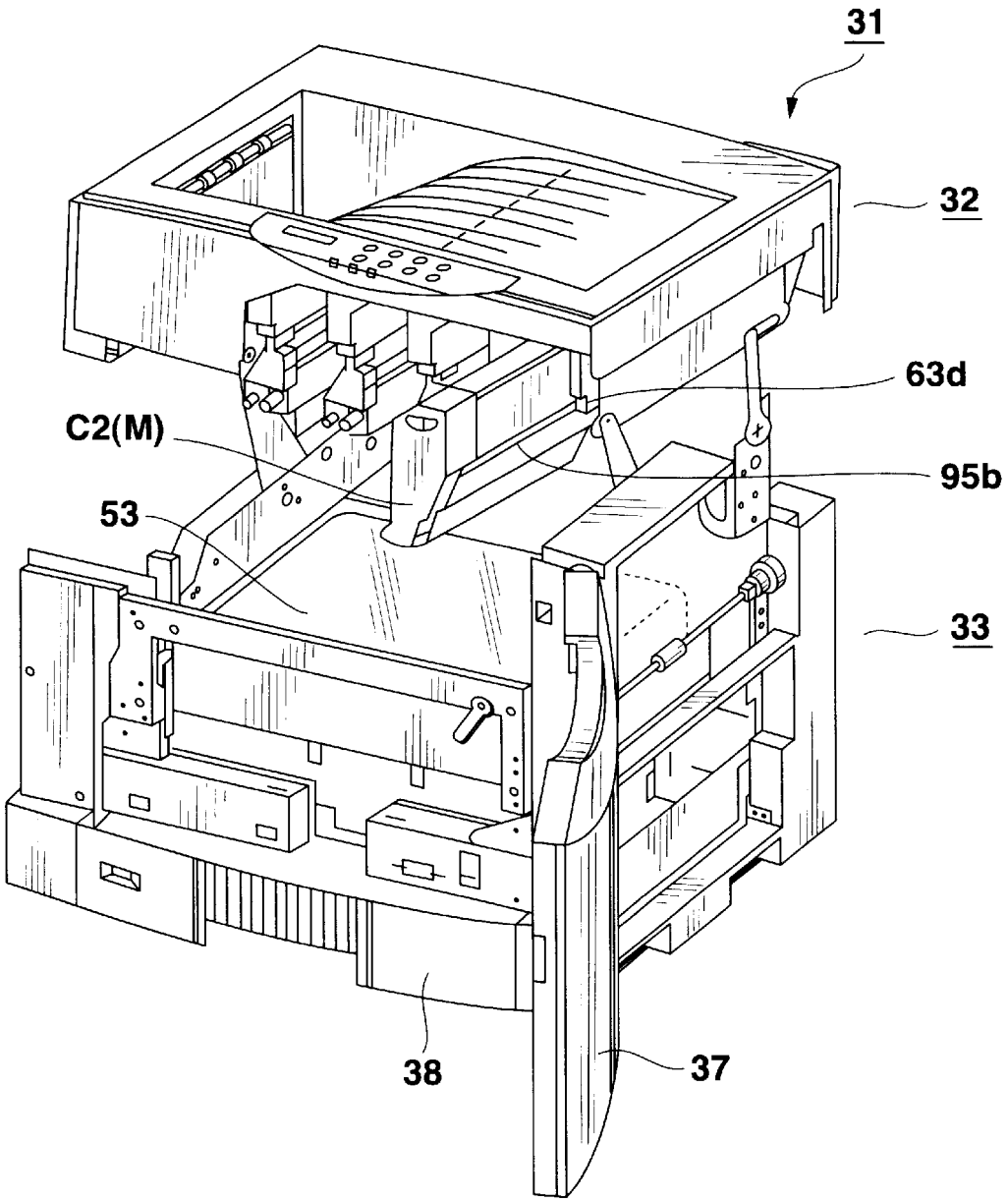
FIG. 18 is a diagram for explaining a state of the printer device according to the one embodiment of this invention, wherein the upper body is completely opened, for explaining a procedure for replacing a toner unit with a new toner unit.
Figure 19:
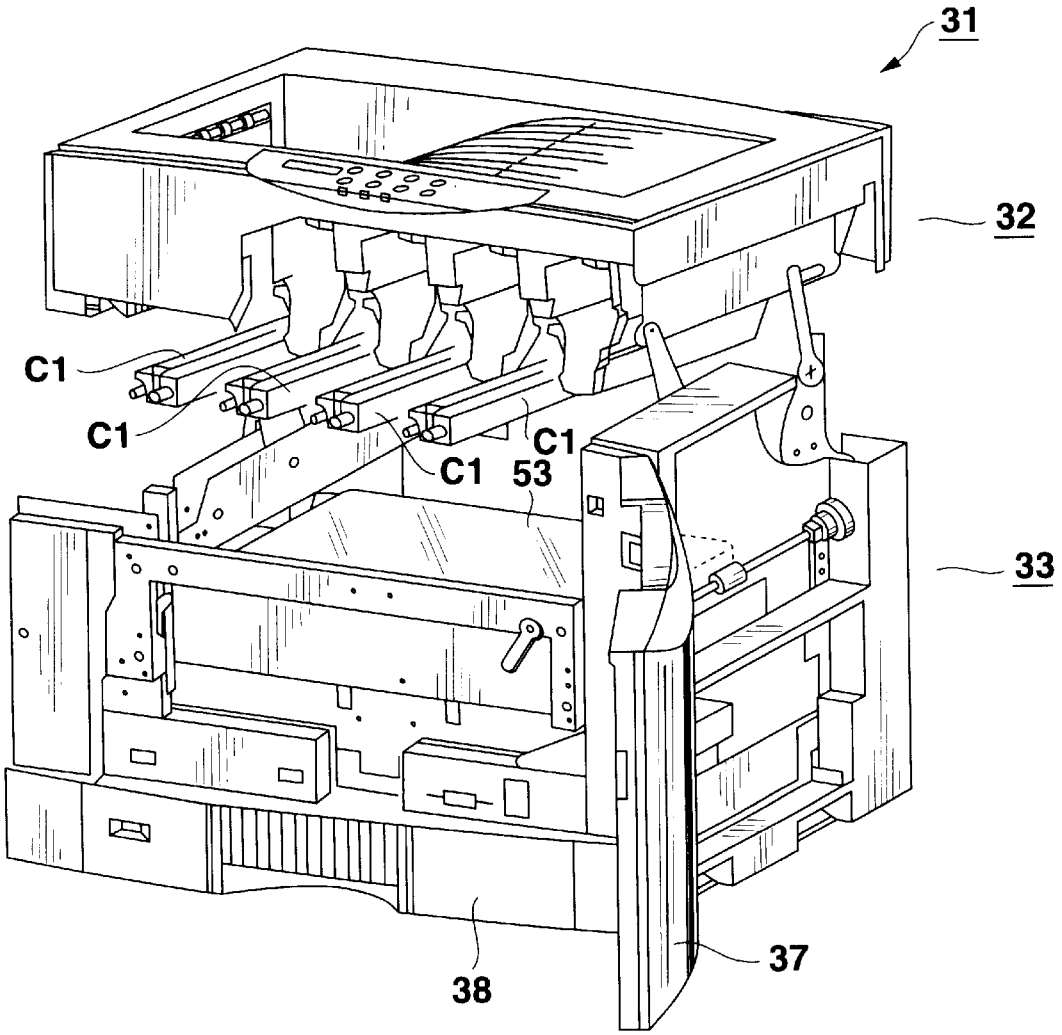
FIG. 19 is a diagram for explaining a state of the printer device according to the one embodiment of this invention, wherein the upper body is completely opened, for explaining a procedure for replacing a drum unit with a new drum unit.

FIG. 5 is an outside perspective view of the printer device, wherein the upper body 32 is opened by manipulation of the link mechanism. As illustrated in FIG. 5, the upper body 32 is opened in parallel with respect to the lower body 33 by manipulation of the link mechanism included in the printer device 31. In the case where to replace any one of the drum units C1 with new one, the drum unit C1 is pulled out as shown in FIG. 19, and is replace with a new drum unit C1. Similarly, in the case where to replace any one of the toner units C2 with new one, the toner unit C2 is pulled out as shown in FIG. 18, and is replace with a new toner unit C2. Accordingly, in the printer device of this embodiment, each of the drum units C1 and each of the toner units C2 can independently be detached from and attached to the printer device.

The link mechanism 64 comprises a link frame 66, an F arm 67, an R arm 68, a stay 69, and an FR frame 65, on both sides of the printer device 31. One ends of the respective F arm 67 and R arm 68 are connected to and rotatively support the link frame 66 arranged on the upper body 32. The other end of the F arm 67 is connected to and rotatively supports the FR frame 65 arranged on the lower body 33. The other end of the R arm 68 is connected to and rotatively supports the stay 69 which is fixed on the FR frame 65. In this structure, the upper body 32 is opened in parallel with respect to the lower body 33, and is moved backward with respect to the lower body 33.

In FIG. 5, those sections included in the link mechanism 64 only on the right side of the printer device 31 are denoted by reference numerals, for the sake of simple illustration. In the following explanations, those sections in the link mechanism on the left side of the printer device 31 are denoted by reference numerals with "a", while those sections in the link mechanism on the right side thereof are denoted by reference numerals with "b". Hence, in FIG. 5, the link frame is denoted by 66*b*, the F is denoted by 67*b*, the R arm is denoted by 68*b*, the stay is denoted by 69*b*, and the FR frame is denoted by 65*b*, which are included in the link mechanism on the right side of the printer device.

Figure 6:
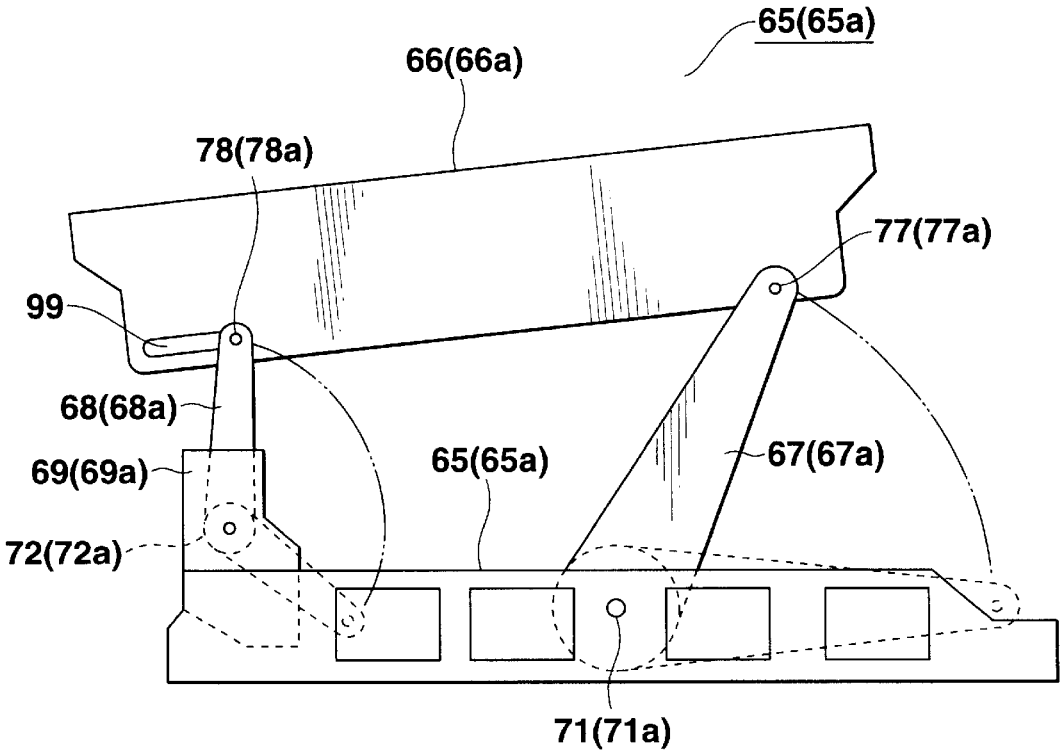
FIG. 6 is a schematic diagram showing a link mechanism, included in the printer device according to the one embodiment of this invention, viewed from the left side of the printer device.
Figure 7:
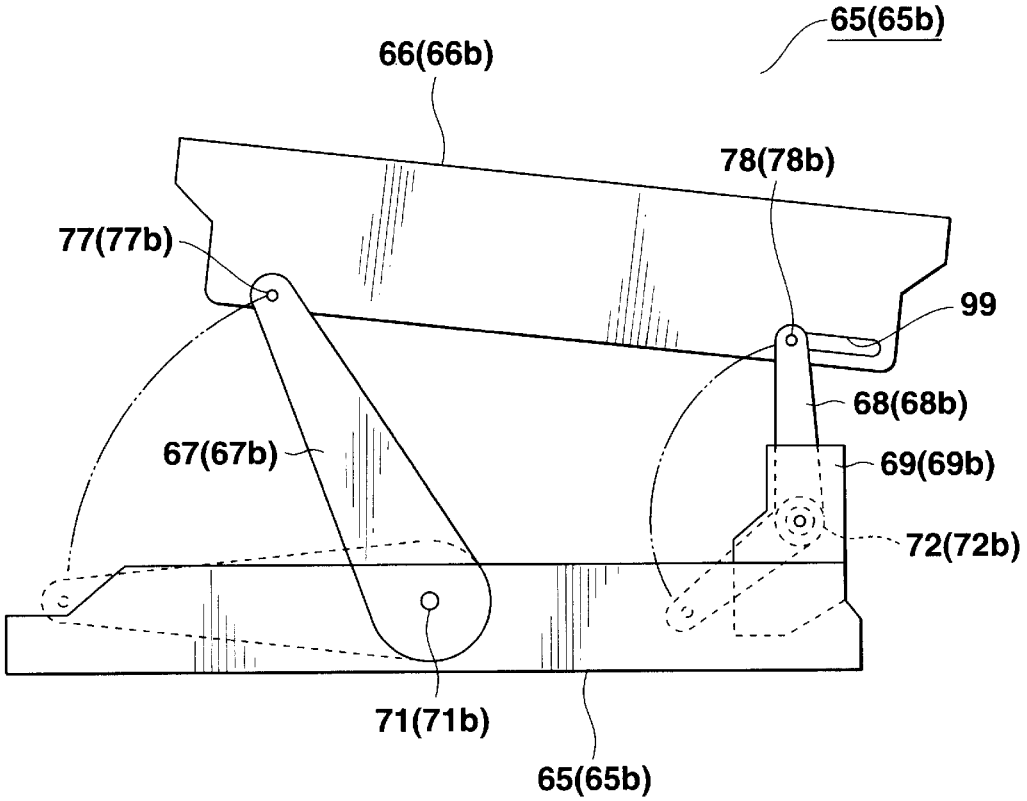
FIG. 7 is a schematic diagram showing a link mechanism, included in the printer device according to the one embodiment of this invention, viewed from the right side of the printer device.
Figure 8:
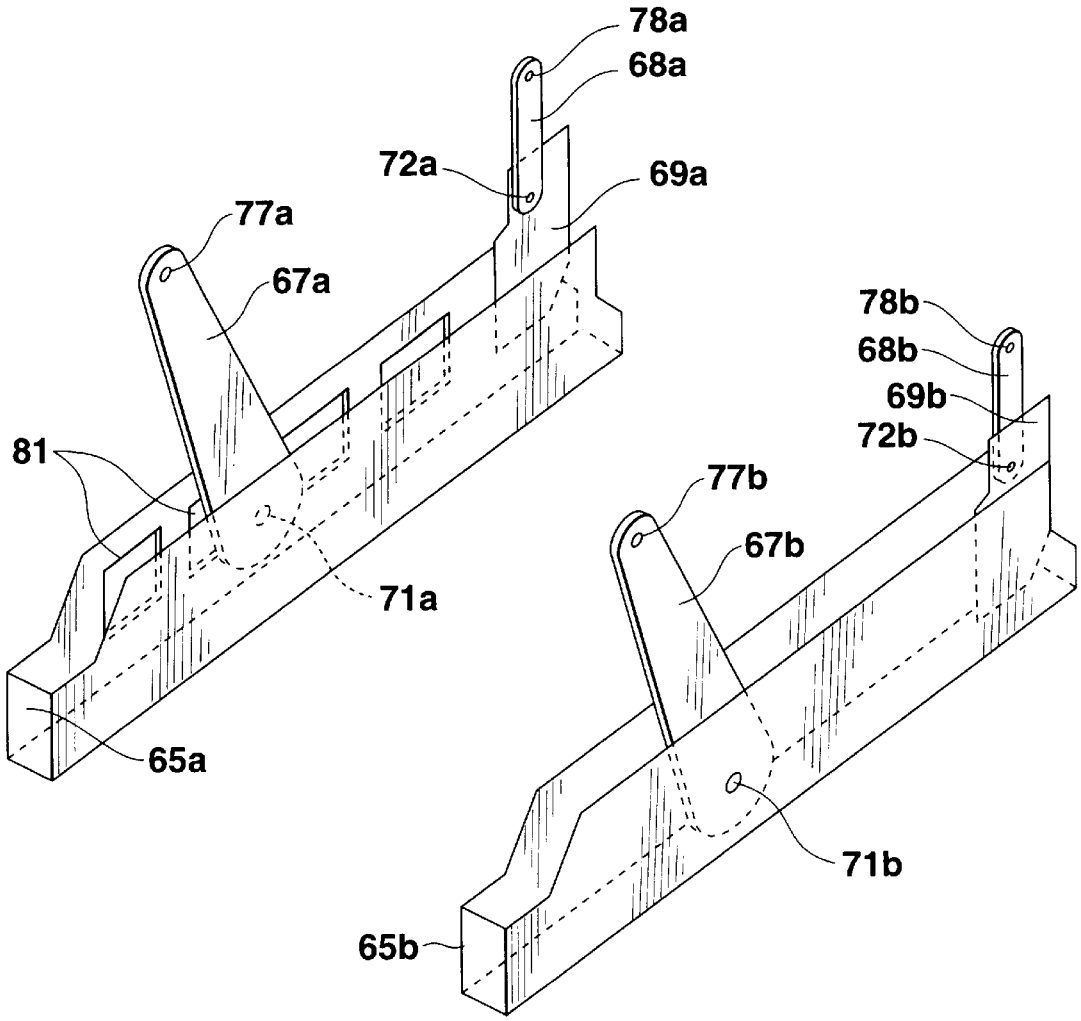
FIG. 8 is a schematic diagram showing the link mechanism taken apart from other parts of the printer device according to the one embodiment of this invention.

FIGS. 6 and 7 are schematic diagrams of the link mechanism. Particularly, FIG. 6 shows a schematic diagram of the link mechanism viewed from the left side-surface thereof, and FIG. 7 shows a schematic diagram of the link mechanism viewed from the right side-surface thereof. FIG. 8 is a perspective view of the link mechanism. In FIGS. 6 to 8, the link frame 66 (66*a*, 66*b*), the F arm 67 (67*a*, 67*b*), the R arm 68 (68*a*, 68*b*), the stay 69 (69*a*, 69*b*), and the FR frame 65 (65*a*, 65*b*) are the principal components of the link mechanism. In FIG. 8, the link frame 66 (66*a*, 66*b*) is not illustrated.

In FIGS. 6 and 7, the F arm 67 (67*a*, 67*b*) and the R arm 68 (68*a*, 68*b*) illustrated with straight lines are shown in their corresponding positions when the upper body 32 is opened. At this time, the upper body 32 is retained to be opened in approximately in parallel with respect to the lower body 33. The F arm 67 (67*a*, 67*b*) and the R arm 68 (68*a*, 68*b*) illustrated with broken lines are shown in their corresponding positions when the upper body 32 is shifted back toward the lower body 33 so as to be closed.

A supporting section 71 (71*a*, 71*b*) rotatively supports the F arm 67 (67*a*, 67*b*) and the FR frame 65 (65*a*, 65*b*), while a supporting section 72 (72*a*, 72*b*) rotatively supports the R arm 68 (68*a*, 68*b*) and the stay 69 (69*a*, 69*b*). A supporting section 77 (77*a*, 77*b*) rotatively supports the F arm 67 (67*a*, 67*b*) and the link frame 66 (66*a*, 66*b*), while a supporting section 78 (78*a*, 78*b*) rotatively supports the R arm 68 (68*a*, 68*b*) and the link frame 66 (66*a*, 66*b*). The rotational tracks of the F arm 67 and R arm 68 are shown with double dot chain lines, respectively.

As illustrated in FIG. 8, four holes 81 in the form of a square shape are formed in the FR frame 65*a* adjacent to the fixation unit 56. Those holes 81 are formed in order to retain the function of the link mechanism. With those holes 81, the FR frame 65*a* has not only a function for opening/closing the upper body 32, but also a function for radiating heat of the fixation unit 56 as a duct.

Figure 9:
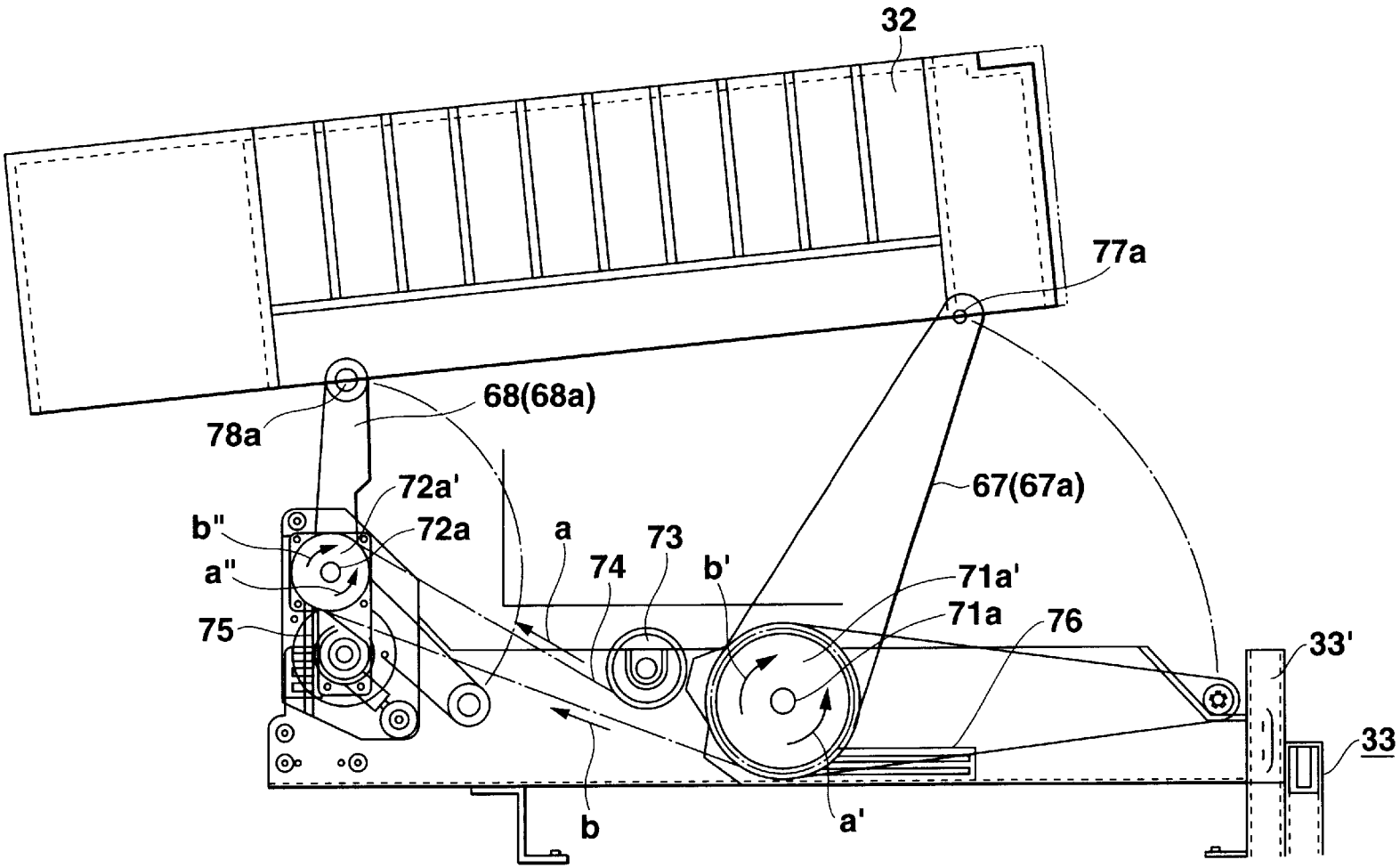
FIG. 9 is a diagram for explaining a driving mechanism having the link structure and included in the link mechanism in the printer device according to the one embodiment of this invention.

FIG. 9 is a diagram for explaining the driving mechanism of the link mechanism. As shown in FIG. 9, the link mechanism is symmetrical. FIG. 9 shows the driving mechanism of the link mechanism which corresponds to that shown in FIG. 6. The front side-surface of the printer device 31 is shown on the right side in the illustration of FIG. 9. As explained above, the F arm 67*a* is rotatively supported by the supporting section 71*a*, and fixed by a rotational gear 71*a*'. The R arm 68*a* is rotatively supported by the supporting section 72*a*, and fixed by a rotational gear 72*a*'. In this structure, the F arm 67*a* and the rotational gear 71*a*' rotate as a unit, and the R arm 68*a* and the rotational gear 72*a*' rotate as a unit.

An intermediate pulley 73 intermediates between the rotational gears 71*a*' and 72*a*'. A gear belt 74 is built between the rotational gears 71*a*' and 72*a*' via the intermediate pulley 73. The intermediate pulley 73 is to give a predetermined level of tension to the gear belt 74.

The rotational gear 72*a*' is engaged with a rotator 75 having a damper mechanism. This rotator 75 includes an oil damper, and has a function for controlling a sudden fall of the upper body 32 according to the law of gravitation so as to make the upper body 32 smoothly fall. The upper body 32 is released up with a spring 76 so as to be opened. One end of this spring 76 is fixed by a casing 33' of the lower body 33, and wound in a few rounds inside the rotational gear 71*a*'. The other end of the spring 76 is fixed in a hole (not illustrated) formed in the F arm 67*a*. The additional tension of the spring 76 causes the rotational gear 71*a*' to rotate in an a'-direction denoted by an arrow a', so that the upper body 32 is released up.

In more particular, when the rotational gear 71*a*' rotates in the a'-direction, the F arm 67*a* is rotated in the same direction. At the same time, the gear belt 74 rotates in an a-direction denoted by an arrow a, and the rotational gear 72*a*' rotates in an a"-direction denoted by an arrow a", and the R arm 68*a* is rotated in the same a"-direction. The link mechanism functions by the above-described driving mechanism. Then, the F arm 67*a* and the R arm 68*a* are rotated in accordance with the rotational tracks, shown with double dot chain lines in the illustration, causing the upper body 32 to be shifted up.

Figure 10:
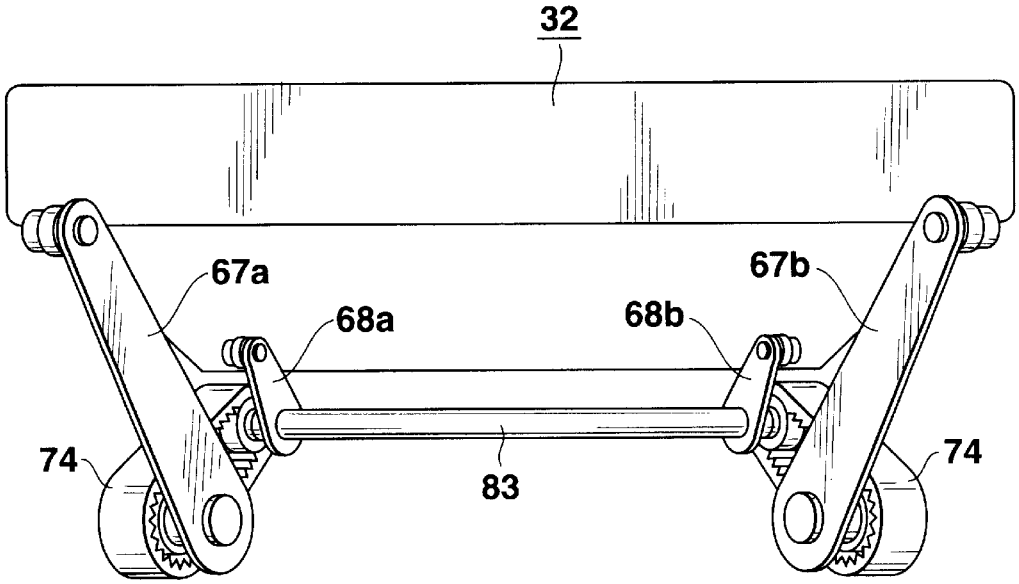
FIG. 10 is a diagram for explaining the link structure, wherein connection members are connected with each other, in the link mechanism included in the printer device according to the one embodiment of this invention.

FIG. 10 is a diagram showing the structure of the link mechanism, viewed from the front. In FIG. 10, the illustration of the FR frame 65 (65*a*, 65*b*) and the spring 76 is not made. A connection member 83 is arranged between the R arms 68*a* and 68*b*.

Figure 11:
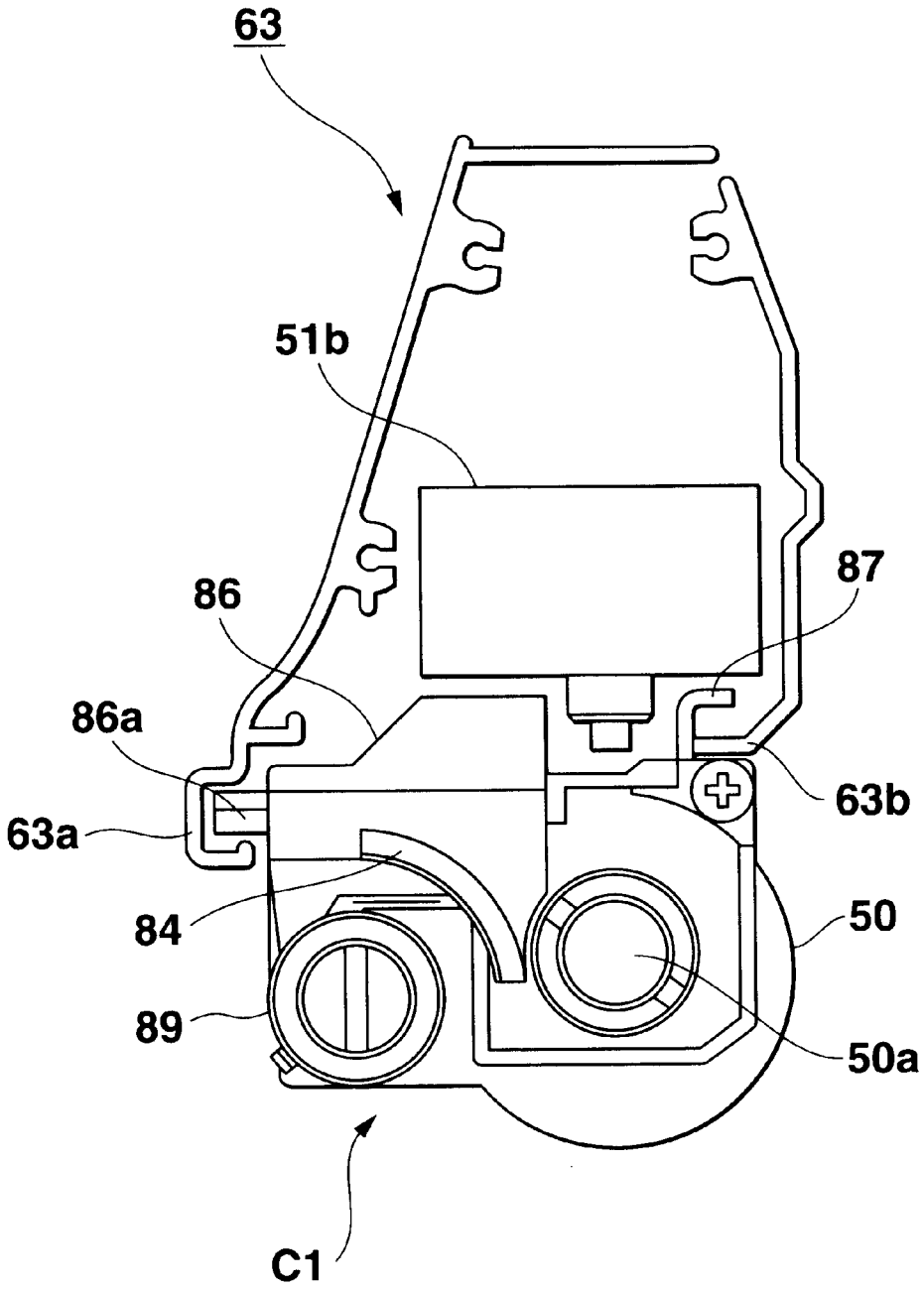
FIG. 11 is a diagram showing a drum unit, which is installed in the printer device according to the one embodiment of this invention, viewed from the front side of the printer device.

FIG. 11 is a diagram showing the state where the drum unit C1 in installed in the printer device 31, viewed from the front. In the illustration, a part of the unit installation section 63 and the printing head 51*b* are shown. A part of the unit installation section 63 is formed in a rail-like shape for making the drum unit C1 and the toner unit C2 slide in horizontal directions and be detached from and attached to the printer device 31. In FIG. 11, the structure of the link mechanism for detaching and attaching the drum unit C1 from and to the printer device 31 is illustrated. In the structure, rail sections 63*a* and 63*b* along which the drum unit C1 slide approximately in a horizontal direction and for installing the drum unit C1 in the printer device 31 are included.

When to install the drum unit C1 in the printer device 31 with utilization of the unit installation section 63, the operator of the printer device 31 holds the drum unit C1, and sets the positions of a projection 86*a* of the drum unit C1 and a DS stay 87 to adjust to the positions of the rail sections 63*a* and 63*b*. While doing this, the operator presses the drum unit C1 approximately evenly into the printer device 31. Then, the projection 86*a* and the DS stay 87 slide along the rail sections 63*a* and 63*b*, respectively, while being hung over the rail sections, and are moved to the end. When one end of the drum unit C1 is detected by a non-illustrative sensor in the printer device, the installation of the drum unit C1 completes. The toner unit C2 is installed in the printer device in the above process. In more particular, the positions of projections 95*a* and 95*b* (refer to FIGS. 3, 4 and 12A to 12C) of the toner unit C2 are adjusted to the positions of rail sections 63*c* and 63*d* (shown with reference numerals for the toner unit of magenta (M) in FIG. 3) arranged in the unit installation section 63. Then, the toner unit C2 slides in a horizontal direction and are detached from or attached to the printer device 31.

Figure 12A:
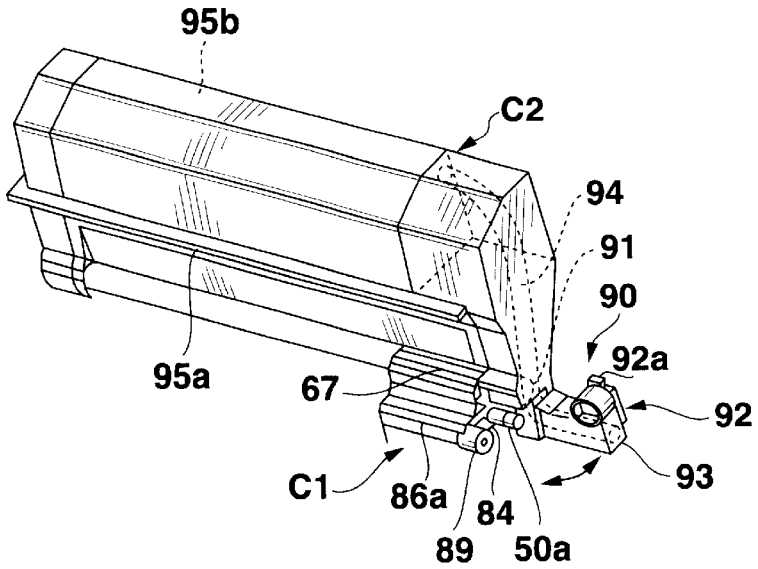
FIGS. 12A, 12B and 12C are diagrams for explaining a series of procedures for installing a drum unit and a toner unit in the printer device and for connecting the drum unit and the toner unit with each other, in the printer device according to the one embodiment of this invention.
Figure 12B:
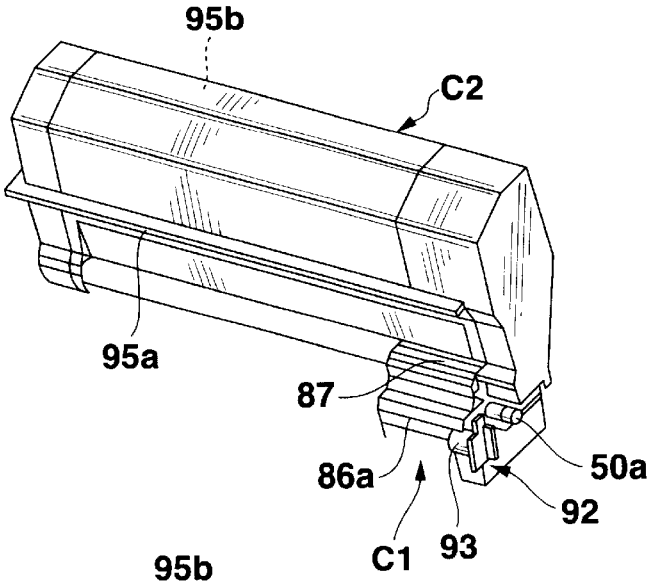
Figure 12C:
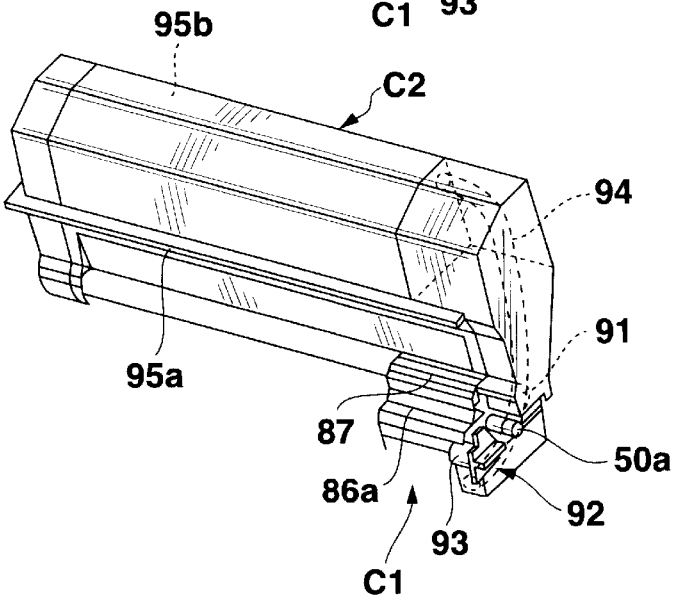

The drum unit C1 and the toner unit C2 are installed in the printer device so as to be connected with each other. The drum unit C1 and the toner unit C2 have a toner collection mechanism, which functions in the state where the drum unit C1 and the toner unit C2 are connected. The drum unit C1 removes toner (waste toner) remaining on the circumferential surface of the photosensitive drum 50 using the toner collection mechanism. After this, the remaining toner can be conveyed to the toner unit C2 through an interconnection mechanism (including a DS shutter and a TS shutter, as will be explained later) which intermediates between the toner unit C2 an the drum unit C1. Therefore, after the installation of the drum unit C1 and the toner unit C2, it is necessary to connect both of them. However, at this time, the interconnection mechanism (including the DS shutter and the TS shutter, etc., as will be explained later) is arranged on one longitudinal side of the unit body of the drum unit C1 and the toner unit C2, as shown in FIG. 12A. A connection section of the toner unit C2 (hereinafter referred to as a DS connection section 90) is rotatable, as illustrated in FIGS. 12A to 12C, in such a manner that the DS connection section 90 does not obstacle to the installation or detachment of the drum unit C1.

Immediately after the installation of the drum unit C1 and the toner unit C2 in the printer device (or the drum unit C1 and the toner unit C2 are disconnected from each other so as to be detached from the printer device), the drum unit C1 and the toner unit C2 are in the state shown in FIG. 12A. The DS connection section 90 of the toner unit C2 is rotatively connected (rotatable in a direction shown with an arrow in the illustration) to the toner unit C1 through a rotatable-connection section 91 (bear-ring, ring, or the like). When the toner unit C2 is disconnected from the drum unit C1, the DS connection section 90 rotates in a such a position where the rotation of the DS connection section 90 does not obstacle to the installation or detachment of the drum unit C1, as shown in FIG. 12A (hereinafter the position is referred to as an opening position).

The DS connection section 90 has a TS shutter, or the like. Such a TS shutter is composed of mainly a TS shutter operational section 92 and a joint section 93. For example, the operator of the printer device 31 rotates the DS connection section 90 against the additional tension of the spring by hand, from the position shown in FIG. 12A to the position shown in FIG. 12B. Then, the joint section 93 is fixed into a shutter 89 of the drum unit C1. In this state, after the operator rotates by hand the TS shutter operational section 92 in a clockwise direction by an angle of 90°, the drum unit C1 and the toner unit C2 are in the state illustrated in FIG. 12C. By doing so, the DS shutter and the TS shutter are opened, and a toner conveyer path directed from the drum unit C1 to the toner unit C2 is conducted. The waste toner is conveyed to a toner collection bag (not illustrated) from the drum unit C1 through the DS shutter 89, the TS shutter and a toner carrier tube 94. A guide 84 which has a U-shaped gap having the shape of one quarter of a circle is arranged on the drum unit C1. The shutter operational section 92 includes a hook 92*a* which is engaged with the U-shaped gap of the guide 84. If the TS shutter operational section begins to be rotated in a clockwise direction from the state shown in FIG. 12B, the hook 92*a* is engaged with the U-shaped gap and moves along the guide 84 (along the one quarter of a circuit, as described above). After the TS shutter operational section is rotated until reaching the position shown in FIG. 12C, the TS shutter operation section is locked. This completes the connection of the drum unit C1 and the toner unit C2.

Figure 13:
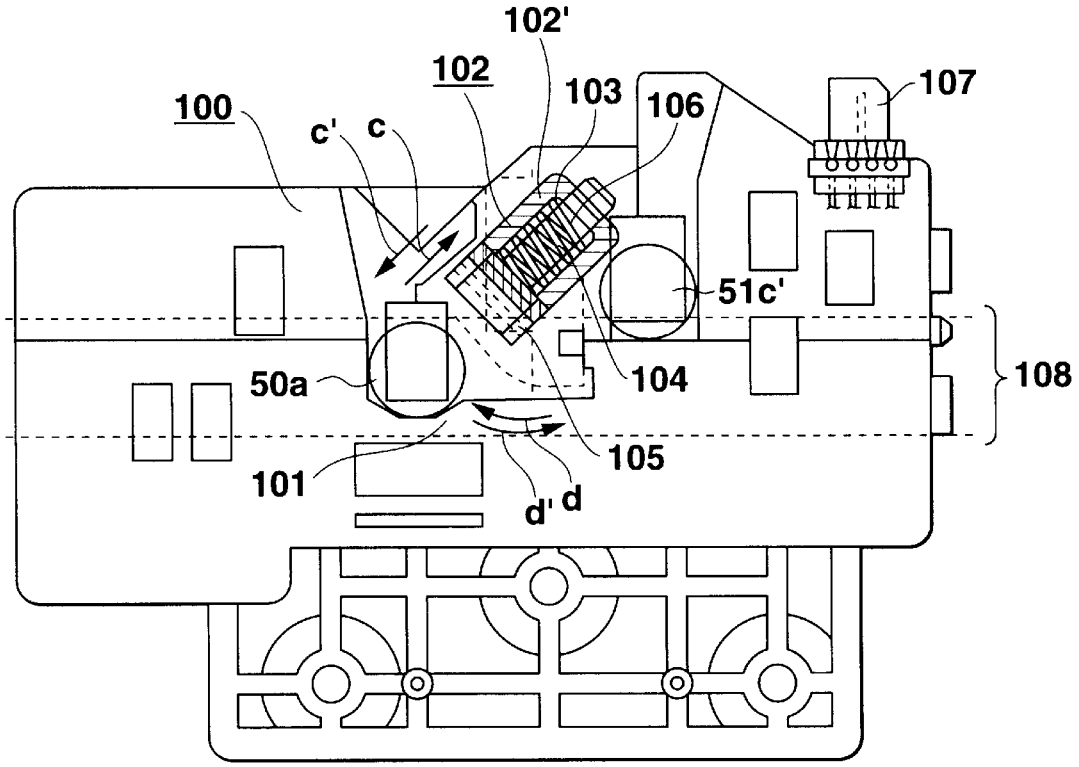
FIG. 13 is a diagram for explaining a locking mechanism included in a shaft receiver receiving a drum shaft of a drum unit, in the printer device according to the one embodiment of this invention.

FIG. 13 is a diagram for explaining the structure of the shaft receiver. Particularly, FIG. 13 shows the structure of one shaft receiver of the four shaft receivers, which are explained above. A shaft receiver 100 is one for a drum shaft, i.e. the drum shaft 50*a* shown in FIG. 13, of the photosensitive drum 50. A concave section 101 is the position in which the drum shaft 50*a* is set. For example, the drum shaft 50*a* approaches downward and set into the concave section 101. A shaft receiving member 102 includes a spring 103. The spring 103 is slidable and arranged on the outer circumference of a supporting shaft 104. The spring 103 is arranged between a casing 102' and the supporting shaft 104. A sliding member 105 is arranged on one end of the spring 103, so that the spring 103 can move in both directions shown with arrows c and c'. The arrow c' shown in FIG. 13 indicates the direction of the addition tension of the spring 103.

The shaft receiving member 102 axially rotates in both directions of arrows d and d' about a supporting shaft 106. This rotation is caused by an actuator 108 shown in FIG. 14. Broken lines shown in FIG. 13 show the position of the actuator 108. A dotted circle 51*c*' shows a roller axis of the developing roller 51*c*. A reference numeral 107 denotes a switch. The square-shaped sections with various sizes in the shaft receiver 100 indicate openings.

Figure 14:
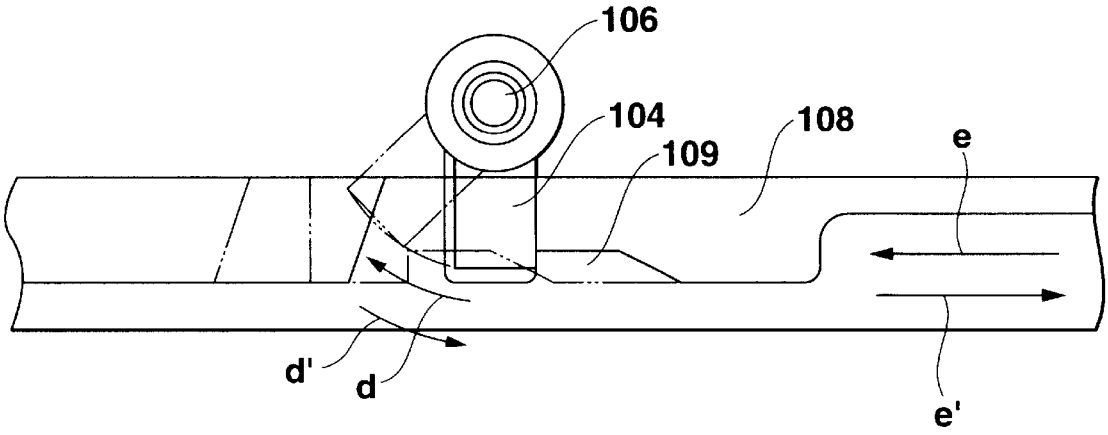
FIG. 14 is a diagram for explaining operations of an actuator of a position determination shaft locking mechanism included in the printer device according to the one embodiment of this invention.

The actuator 108 is driven in both directions of e and e', as shown in FIG. 14, whereby the supporting shaft 104 of the shaft receiving member 102 is driven in directions of d and d'. A convex section for driving 109 is arranged in the actuator 108. In this structure, the shaft receiving member 102 is driven in both directions of d and d' in accordance with the movement of the actuator 108 in directions of e and e'. The shaft receiving member 102 is driven centrically about the supporting shaft 106. The supporting shaft 104 shown in FIG. 104 is in a position which can not be seen in the structure of the shaft receiver of FIG. 13.

Figure 15:
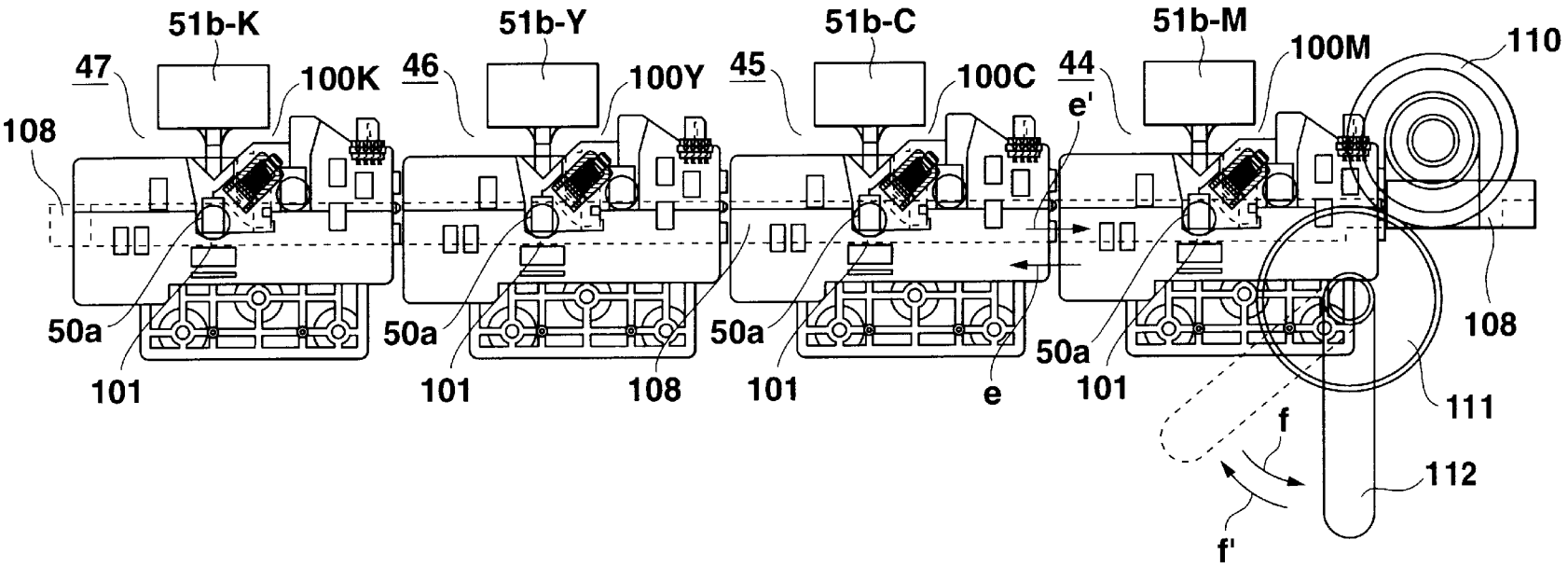
FIG. 15 is a diagram for explaining the position determination shaft locking mechanism in the printer device according to the one embodiment of this invention.

FIG. 15 shows the structure of four shaft receivers 100 which correspond to the respective image formation units 44 to 47 (drum unit C1) of the colors of magenta (M), Cyan (C), Yellow (Y) and Black (K). For example, the shaft receiver 100M corresponds to the image formation unit 44 (drum unit C1), the shaft receiver 100C corresponds to the image formation unit 45 (drum unit C1), and the rest follows as illustrated in FIG. 15. Hence, the printing head 51*b*-M is arranged right above the shaft receiver 100M, and a drum shaft 50*a* of its corresponding photosensitive drum 50 is set into the concave section 101. The printing head 51*b*-C is arranged right above the shaft receiver 100C, and a drum shaft 50*a* of its photosensitive drum 50 is set into the concave section 101. The same applies to the rest of the image formation units 46 and 47.

The actuator 108 has the structure for driving the four shaft receiving members 102. The convex sections 109 (refer to FIG. 14) is arranged as to correspond to each of the four shaft receiving members 102. A rotator 110 is arranged on one end of the actuator 108. A gear arranged on the circumferential surface of the rotator 110 is engaged with a rack gear arranged on the one end of the actuator 108 within a predetermined area of the actuator 108. The gear arranged on the outer circumference of the rotator 110 is to be engaged with a gear arranged on the circumferential surface of a driving gear 111. This causes the driving gear 111 to be rotated, resulting in rotating the rotator 110. A lever 112 (refer to FIG. 2) is arranged in the driving gear 111. The actuator 108 is driven in the directions of e and e' (refer to FIG. 14) through the driving gear 111 and the rotator 110, by manipulation of the lever 112.

Explanations will now be made to a link process for linking the upper body 32 to the lower body 33, a detaching and attaching operation of the drum unit C1 and the toner unit C2 from and to the printer device 31, and a lock operation for locking the image formation units 44 to 47 (drum units C1).

Generally, the printer device 31 is used in the state shown in FIG. 1. If it is run out of paper, an instruction to supply paper is displayed on the liquid crystal display 34*b* of the operation panel 34. Then, the user of the printer device 31 supplies the feeding cassette 38 with paper. If a paper is stacked in some position in the printer device, the position is displayed on the liquid crystal display 34*b*. Then, the user of the printer device 31 opens the cover 40, for example, to clear the jam.

If a paper is stacked in some position inside the printer device 31 (if the position does not correspond to the position of the cover 40), or if the drum unit C1 or the toner unit C2 needs to be replaced, or if a maintenance process is performed for any other part inside printer device 31 the front cover 37 is opened. The state of the printer device whose front cover 37 is opened is illustrated in FIG. 2.

In this state of the printer device 31, the upper body 32 is opened and unlocked. In order to accomplish the unlocking of the upper body 32, the lever 112 is moved in a direction of an arrow f as illustrated in FIG. 15 so as to move the lever 112 from the position shown with a straight line to the position shown with a broken line, as shown in the illustration. By this manipulation, the rotator 110 rotates in the same direction (in the direction of f), and the actuator 108 is driven in the direction of e' (refer to FIG. 14) through the rotator 110 and the rack gear. The actuator 108 is driven, thereby the shaft receiving member 102 of the respective shaft receivers 100M to 100K are rotated in the direction of d'. The shaft receiving member 102 in the position shown with double dot chain lines is returned to the position shown with straight lines, shown in FIG. 14. A non-illustrative elastic member realizes addition tension for forcing the shaft receiving member 102 to move into the direction of d'.

Upon driving of the actuator 108, the shaft receiving member 102 is moved from the position of a straight line to the position of a double dot chain line. In this structure, the drum shaft 50*a* is unlocked.

Together with the unlocking operation, a mechanism (not illustrate) for locking the upper body 32 and the lower body 33 is not driven. Hence, the F arm 67*a* is rotated in the direction of the arrow a', the gear belt 74 is rotated in the direction of the arrow a, and the R arm 68*a* is rotated in the same direction (arrow a) by the additional tension of the spring 76, as shown in FIG. 9. In the link mechanism of this embodiment, the ratio of the length of the F arm 67 (67*a*, 67*b*) to the length of the R arm 68 (68*a*, 68*b*) is set to 2 to 1. In addition, the position of the supporting section 71 (71*a*, 71*b*) is different from the position of the supporting section 72 (72*a*, 72*b*), hence the position of the front section of the upper body 32 is slightly higher than the position of the back section thereof, when to open the upper body 32. At the same time, the upper body 32 is lifted up while being shifted slightly backward. The supporting section 78 (78*a*, 78*b*) slides along a slide gap 99, so as to gradually raise the upper body 32.

Figure 16:
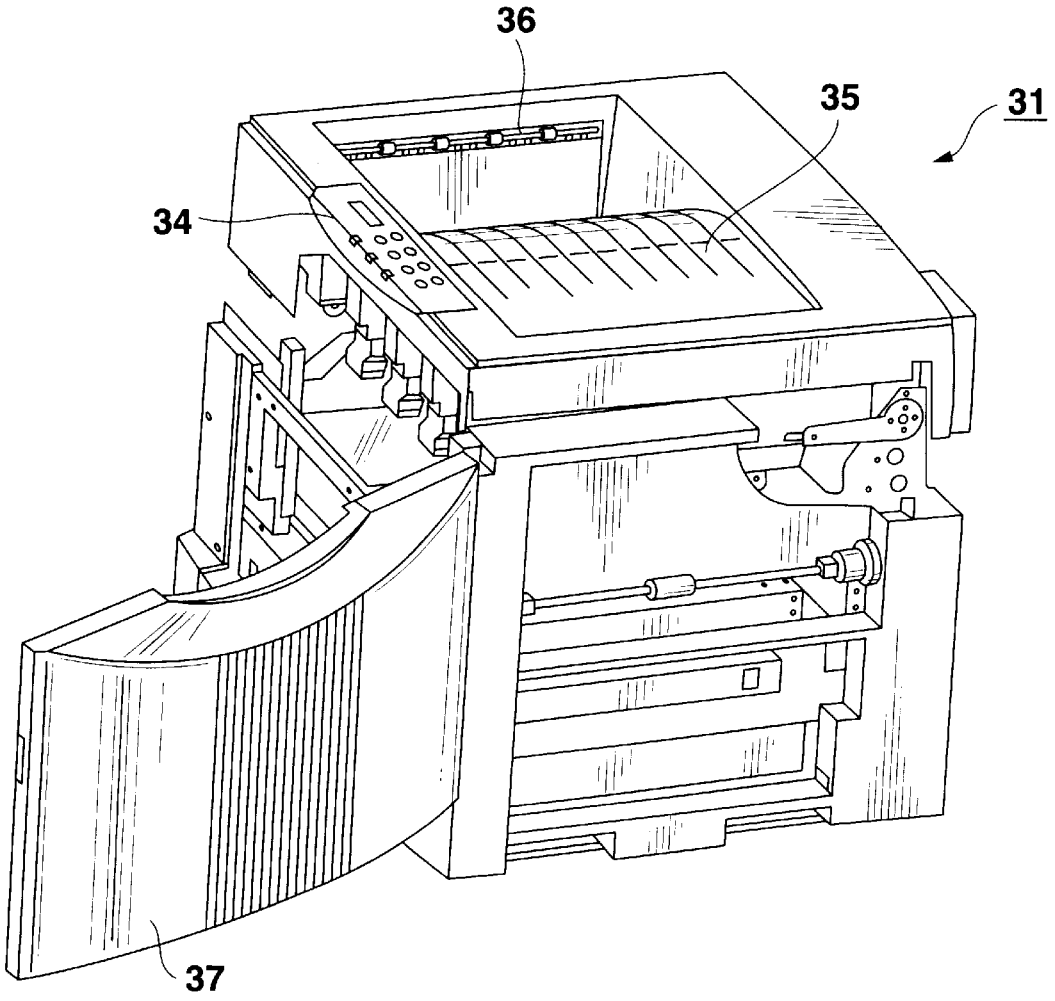
FIG. 16 is an outside perspective view showing a state of the printer device according to the one embodiment of this invention, wherein a link mechanism is operated and the upper body is slightly shifted upward.

FIG. 16 shows the state of the printer device 31, wherein the link mechanism is operated and the upper body 32 is slightly shifted up. In the illustration, only the principal components of the link mechanism are illustrated, and the illustration of the MPF tray 39' and the cover 40 is not made.

The upper body 32 is further shifted up, and reaches a predetermined position so as to be opened. At this time, the printer device 31 is opened in the state where the position of the front section of the upper body 32 is higher than the position of the back section thereof and the upper body 32 is slightly shifted backward so as to be opened, on the basis of the ratio of the length of the F arm 67 (67*a*, 67*b*) to the length of the R arm 68 (68*a*, 68*b*). In this structure, the drum unit C1 or the toner unit C2 is easily replaced, and the maintenance operations can easily be performed.

Figure 17:
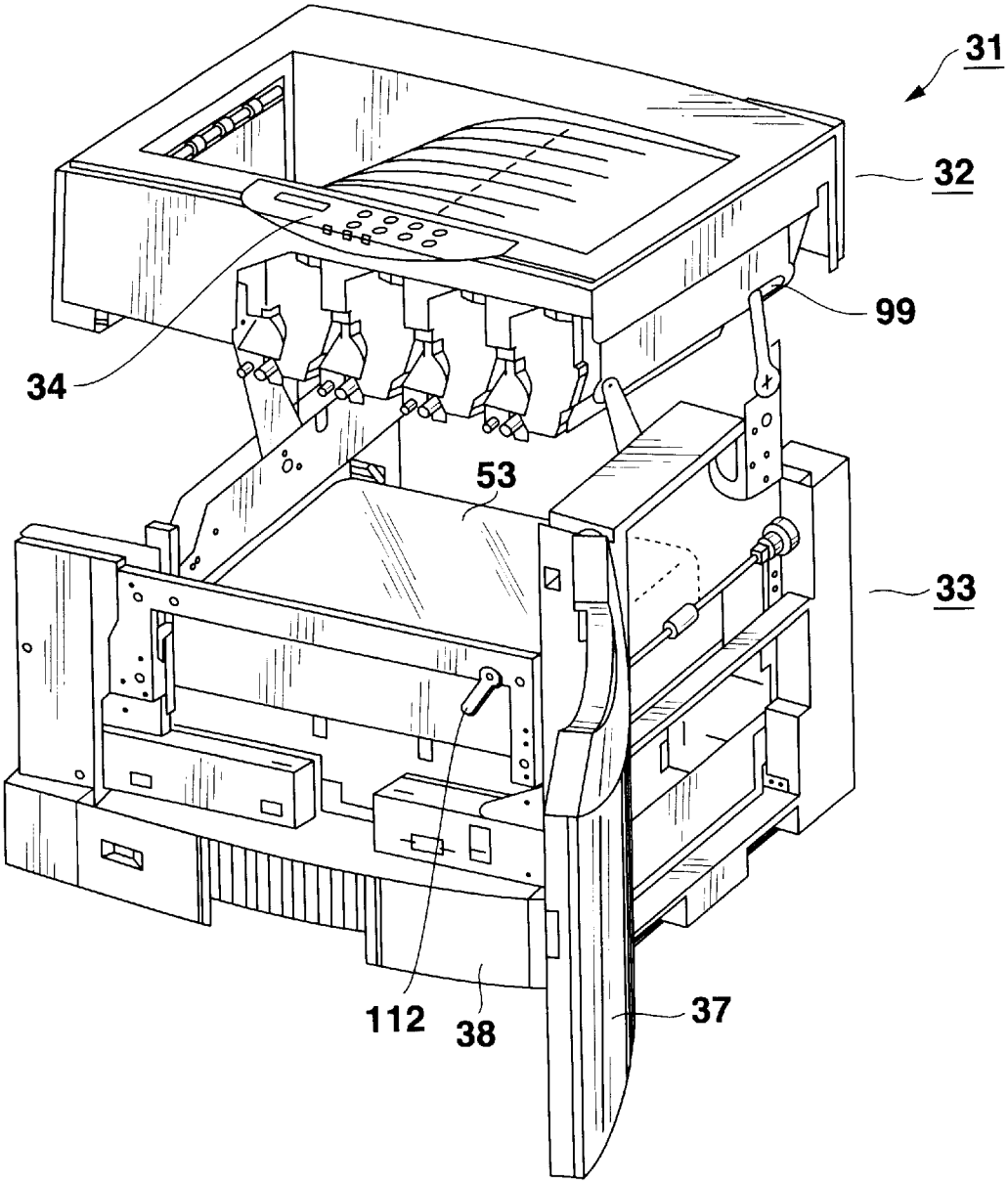
FIG. 17 is an outside perspective view showing a state of the printer device according to the one embodiment of this invention, wherein the link mechanism is operated and the upper body is completely opened.

FIG. 17 is a diagram showing the state of the printer device 31 where the upper body 32 is completely opened. In the illustration, only the principal components of the link mechanism are shown, and the illustration of the MPF tray 39' or cover 40 is not made. In such state, the upper body 32 is opened parallelly with respect to the lower body 33 at a predetermined interval. This interval is prepared for the sake of the following maintenance operations.

When to replace the toner unit C2 (for example, C2(M)) with a new toner unit C2, the toner unit C2(M) is pulled out, as illustrated in FIG. 18, and a new toner unit C2(M) is installed therein. When to replace the drum units C1 (for example, C1(M) to C1(K)) with new drum units C1, those drum units C1(M) to C1(K) are pulled out as shown in FIG. 19, and new drum units C1(M) to C1(K) are installed therein. Hence, the drum unit C1 and the toner unit C2 can be replaced with ease. In the state where the upper body 32 is opened, the conveyer belt 53 is open as shown in FIGS. 17 to 19, facilitating the maintenance operation or facilitating to clear the jam of paper stacked in the printer device 31.

After the replacing operation of the drum unit C1 or toner unit C2 or the maintenance operation is thus performed, the upper body 32 is pressed down so as to be closed. In this case, the upper body 32 can be closed by the weight of the upper body 32 itself without any addition tension. The upper body 32 can be closed smoothly against the additional tension of the spring 76, by the oil damper. In this case, the gear belt 74 is moved in the direction of arrow b, and the rotational gear 71*a*' is rotated in the direction of arrow b' as shown in FIG. 9. At the same time, the rotational gear 72*a*' is rotated in the direction of arrow b", thereby to shifting back the upper body 32 toward the lower body 33 so as to close the upper body 32. Upon completion of the closing the upper body 32, the mechanism (not illustrated) for locking the upper body 32 and the lower body 33 is driven so that the upper body 32 and the lower body 33 are locked.

After closing the upper body 32 toward the lower body 33, the position of the shaft receiving member 102 is shown with the double dot chain line in FIG. 13 (straight line in FIG. 14), and the position of the lever 112 is above the concave section 101. In this state, the lever 112 is moved from the position of the broken line to the position of the straight line in the direction of arrow f as shown in FIG. 15. By manipulation of the lever 112, the rotator 111 rotates in the same direction (in the direction of arrow f), and the actuator 108 is driven in the direction of arrow e through the rotator 110 and the rack gear (refer to FIG. 14). Because the actuator 108 is driven, the shaft receiving member 102 of each of the shaft receivers 100M to 100K is rotated in the direction of arrow d. The shaft receiving member 102 which is in the position shown with the double dot chain line in FIG. 13 is moved to the position shown with the straight line. The drum shaft 50*a* can be restrained against the direction of arrow c' by the additional tension of the spring 103 so as to be fixed.

All of the four drum shafts 50*a* can be fixed at the same time. The image formation units 44 to 47 can easily be locked by simple manipulation of the lever 112.

In the above-described embodiment, the shaft receiver in the printer device 31 of this embodiment is formed to comprise the actuator 108, the rotator 110, the lever 112, etc. However, the present invention is not limited to the above structure.

If the upper body 32 is shifted back toward the lower body 33 so as to be closed, the photosensitive drum 50 arranged inside the drum unit C1 is arranged adjacent to the developing roller 51*c* included inside the toner unit C2, and the photosensitive drum 50 and the developing roller 51*c* are pressure-welded.

According to the printer device 31 of this embodiment, the plurality of drum units C1 and toner units C2 are arranged in one upper body 32. The upper body 32 is easily opened or closed, thus achieving the maintenance operations, including an operation for replacing the drum unit C1 or toner unit C2 with new one.

The link mechanism is employed for opening and closing the upper body 32. In the structure where the plurality of drum units C1 and toner units C2 are arranged on the upper body 32, high quality printing can be achieved without deterioration in printing performance with stable operations of the printer device 31.

The link mechanism employed in the printer device of this embodiment includes the F arm 67 (67*a*, 67*b*) as the first arm, the R arm 68 (68*a*, 68*b*) as the second arm, the link frame 66 (66*a*, 66*b*) as a member for connecting the above arms, the stay 69 (69*a*, 69*b*), and the FR frame 65 (65*a*, 65*b*). However, the structure of the link mechanism is not limited to this, and modifications can be made thereinto.

Various materials, such as a hard rubber belt, a stainless belt, etc. can be employed as the gear belt 74. The position of the intermediate pulley 73 is not limited to the position shown in FIG. 9. Further, a plurality of intermediate pulley 73 may be employed, or no intermediate pulley may be included.

The structure of the spring 76 is not limited to the above. As long as the spring 76 has the structure for forcing the upper body 32 to shift upward, the spring 76 may be formed of compressed rubber, plate rubber or the like. In addition, a-plurality of springs may be employed. Further, the spring may be formed of other materials, such as a stainless member or the like.

It is preferred that the F arm 67 is longer than the R arm 68, however, the relationship between the length of the F arm 67 and the length of the R arm 68 can be set on the basis of the opening angle of the upper body 32. The position of the FR frame 65 (65*a*, 65*b*) can be determined adequately on the basis of the relationship between the FR frame 65 and other component parts.

Figure 20:
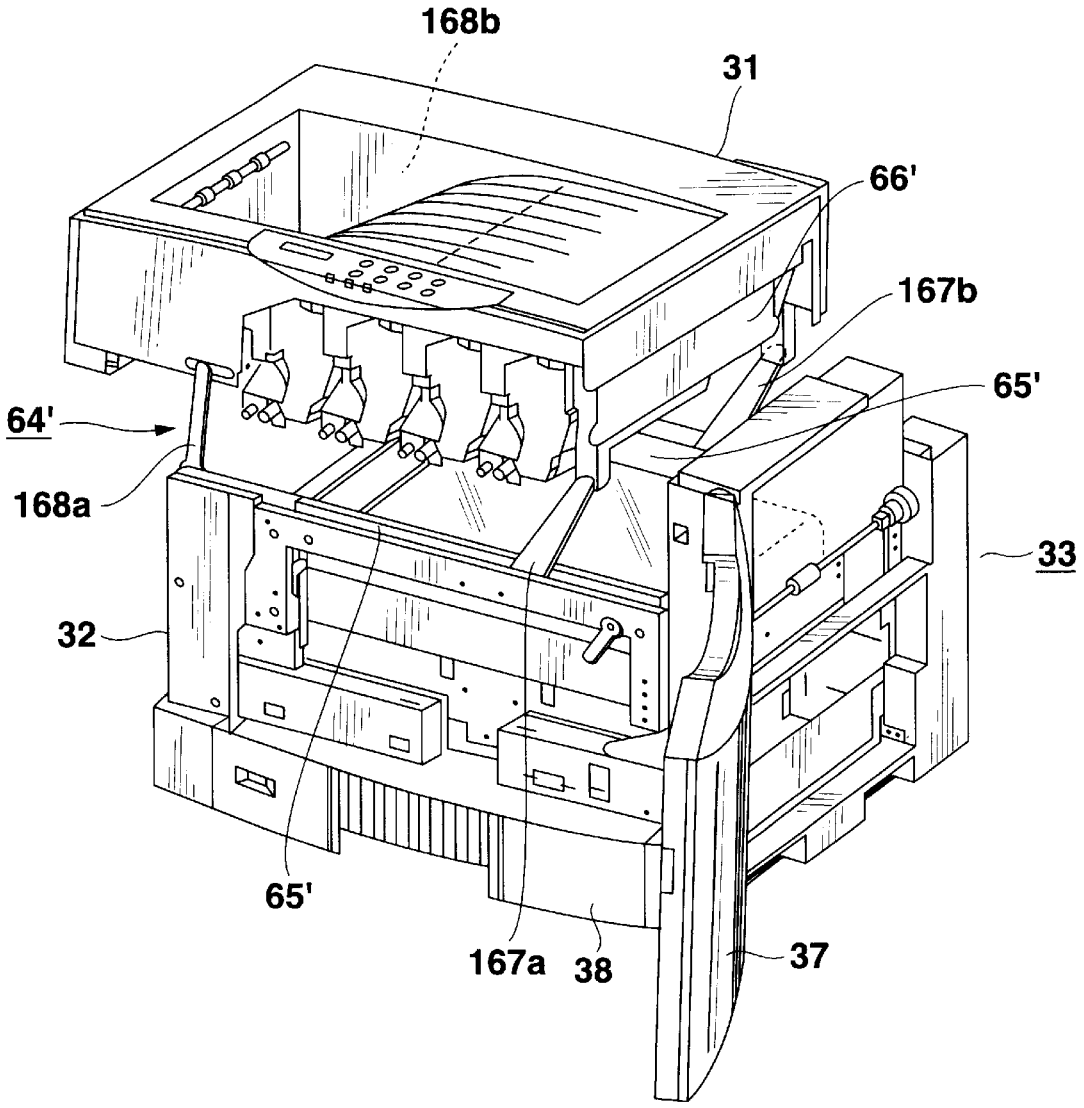
FIG. 20 is a diagram for explaining a link mechanism having a link structure of a modification of this invention.
Figure 21:
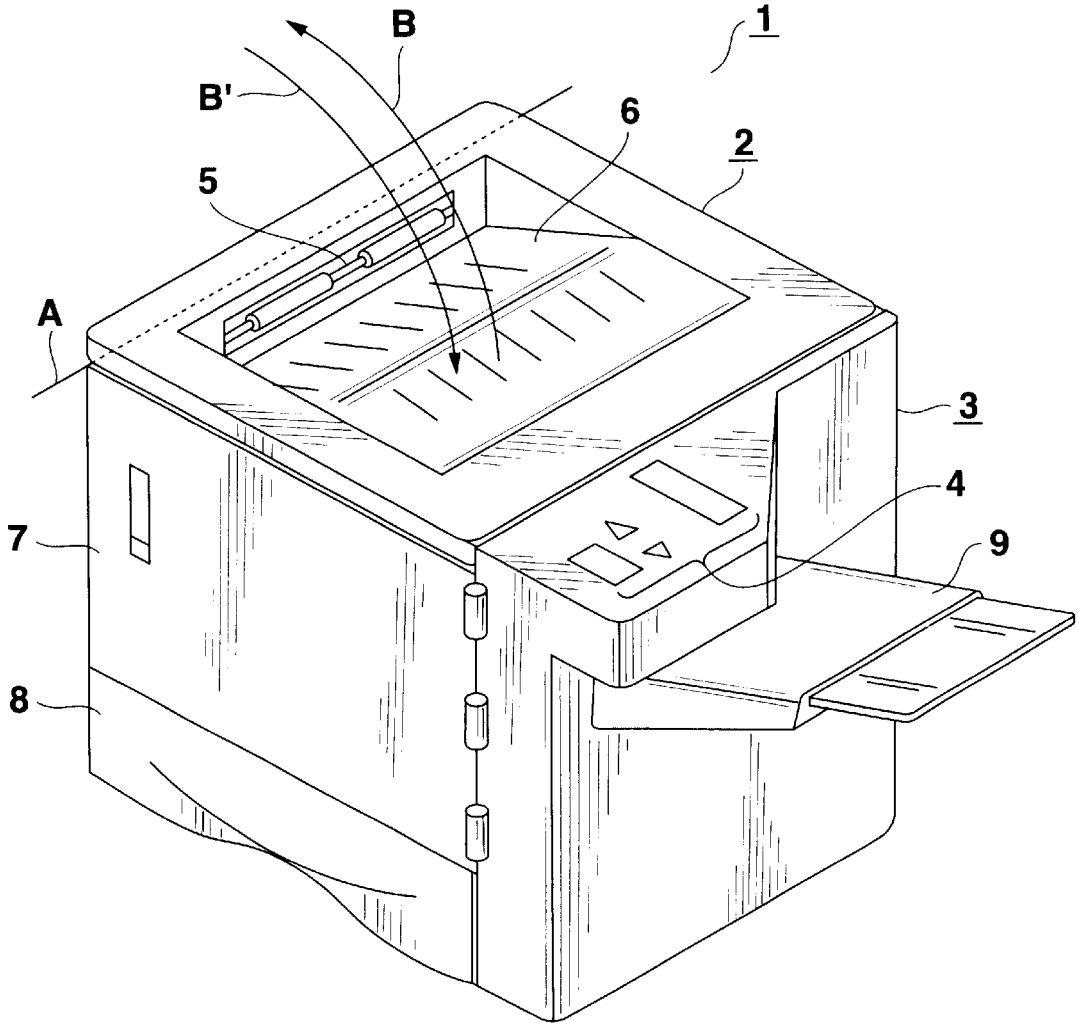
FIG.21 (PRIOR ART)
FIG. 21 is a schematic diagram showing the entire structure of a conventional printer device.
Figure 22:
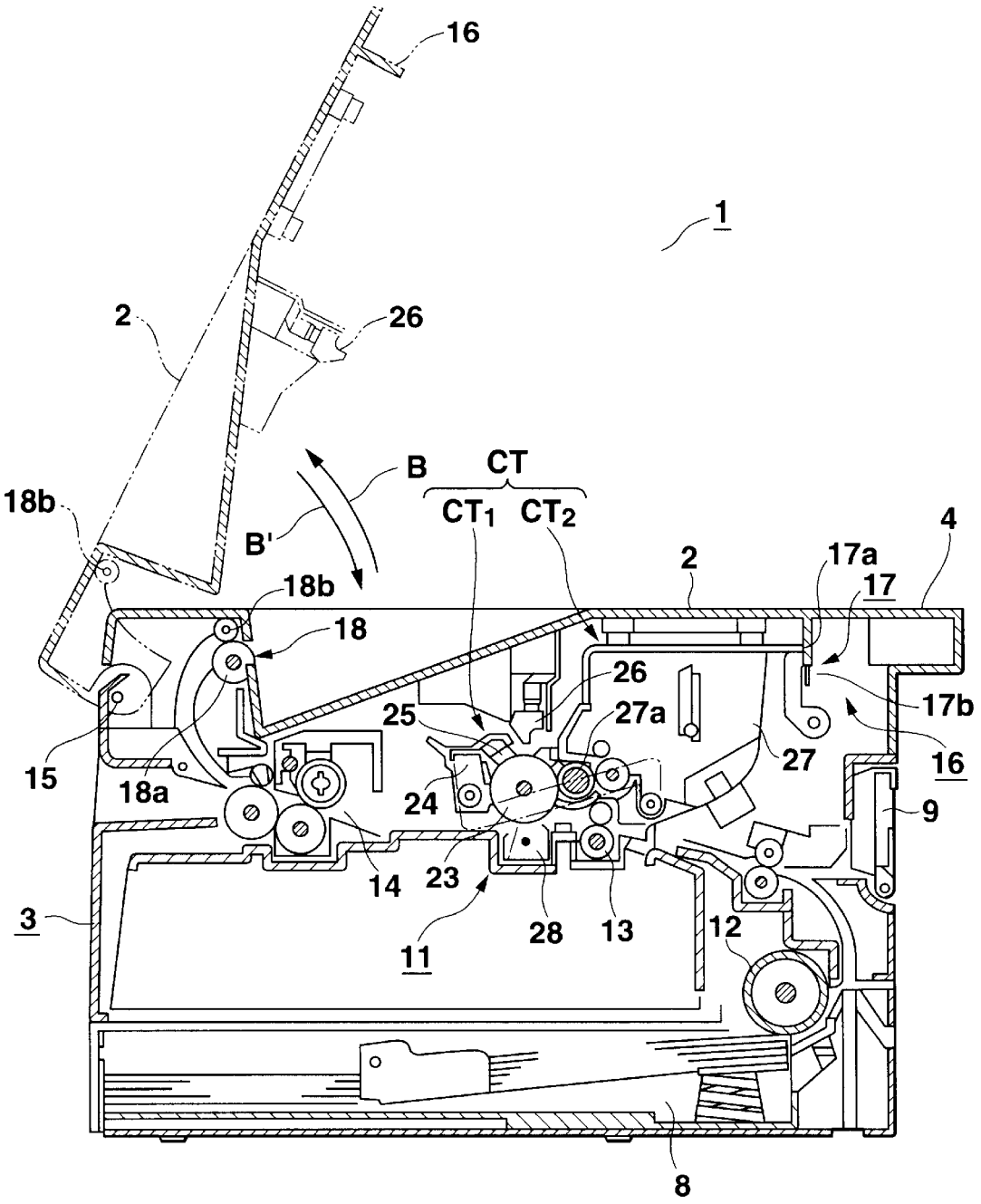
FIG.22 (PRIOR ART)
FIG. 22 is an exemplary cross sectional view showing the internal structure of the printer device shown in FIG. 21.

FIG. 20 shows the state of the printer device including a modification of the link mechanism 64, wherein the upper body is opened. In this structure, the printer device 31 includes link mechanisms 64' in both front and back sides thereof Each of the link mechanisms 64' includes a link frame 66', an FR arm 167 (167*a*, 167*b*), an FL arm 168*a* (RL arm 168*b*, can not be seen in the illustration), and an FR frame 65'. With the link mechanisms 64', the upper body 32 can be opened approximately parallelly with respect to the lower body 33 in an upper left direction, as shown in FIG. 20. Those connections made between the component parts in the printer device are the same as those explained in the first embodiment. According to this structure, as well, the present invention can be realized.

In the above-described embodiment, the explanations have been made to the printer device optionally having the printing mechanism for both-side printing. However, such a mechanism does not have to be included in the printer device. The printer device of this invention does not have to include the MPF tray 39', and a further feeding cassette may be added to the printer device.

As explained, according to the present invention, the positional deviation of the image formation units are unlikely to occur, and thus enhancing the quality of the printing performance.

The drum unit and the toner unit arranged on the upper body can slide in a horizontal direction so as to be detached from the printer device. This facilitates the maintenance operation of the printer device and the replacing operation of the image formation unit.

In addition, the operation for cleaning the jam, such as for clearing a paper stacked somewhere in the printer device, can be achieved with ease.

Furthermore, the plurality of image formation units can easily be locked, because the locking mechanism for locking the image formation units can be realized.

Various embodiments and changes may be made thereonto without departing from the broad spirit and scope of the invention. The above-described embodiment intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application Nos. H11-365621 filed on Dec. 22, 1999, 2000-15782 filed on Jan. 25, 2000, and 2000-16904 filed on Jan. 26, 2000, and including specification, claims, drawings and summary. The disclosure of the above Japanese Patent Application is incorporated herein by reference in its entirety.

What is claimed is:

1. A printer device, which includes a paper conveyer path and image formation means for forming an image on a paper conveyed along said paper conveyer path, and which is dividable into an upper body and a lower body, said printer device comprising:

a body linking mechanism for opening said upper body with a predetermined interval between said lower body, and for connecting said upper body and said lower body, wherein said body linking mechanism includes:

a pair of first arms each of which has a rotational fulcrum at a central section of either one side surface of said lower body;

a pair of second arms each of which has a rotational fulcrum at an outer section of either one side surface of said lower body; and a pair of link members which are arranged on respective side surfaces of said upper body, and rotatively and oppositely connected to corresponding ones of said respective first and second arms, wherein a posture of said upper body with respect to said lower body is retained, by said body linking mechanism, approximately the same as a posture of said upper body which is closed, when opening said upper body upward with respect to said lower body, and said upper body is shifted in directions except in a forward direction.

2. The printer device according to claim 1, wherein said body linking mechanism further including:

a first and second rotational members each of which has a rotational fulcrum which coincides with the corresponding rotational fulcrum of said first and second arms, and which are rotated along with rotations of said first and second arms; and driving transmission members which are arranged between said first and second rotational members and transmit, to said first and second rotational members, a driving force for forcing said first and second arms to rotate centrically at their rotational fulcrums.

3. The printer device according to claim 1, wherein:

a length of said first arm is larger than a length of said second arm; and a position of the rotational fulcrum of said first arm is higher than a position of the rotational fulcrum of said second arm.

4. The printer device according to claim 1, wherein said image formation means is formed of a plurality of members incorporated with each other, and which includes at least one image formation unit, which is detachable from and attachable to said upper body.

5. The printer device according to claim 4, wherein said upper body includes at least one supporting means for supporting the at least one image formation unit which is slidable in forward and backward directions.

6. The printer device according to claim 4, wherein the image formation unit includes a plurality of image formation units along said paper conveyer path.

7. A printer device, which includes a paper conveyer path and image formation means for forming an image on a paper conveyed along said paper conveyer path, and which is dividable into an upper body and a lower body, said printer device comprising:

a body linking mechanism for opening said upper body with a predetermined interval between said lower body, and for connecting said upper body and said lower body, wherein said body linking mechanism includes:

a link member for linking said upper body with said lower body; and said link member includes a damper which controls a rotational speed of said upper body, when said upper body is rotated so as to be closed, and which does not operate when said upper body is rotated so as to be opened, wherein a posture of said upper body with respect to said lower body is retained, by said body linking mechanism, approximately the same as a posture of said upper body which is closed, when opening said upper body upward with respect to said lower body and said upper body is shifted in directions except in a forward direction.

8. A printer device, which includes a paper conveyer path and image formation means for forming an image on a paper conveyed along said paper conveyer path, and which is dividable into an upper body and a lower body, said printer device comprising:

a body linking mechanism for opening said upper body with a predetermined interval between said lower body, and for connecting said upper body and said lower body, additional tension providing means for providing additional tension for forcing said upper body to be shifted upward with respect to said lower body in such a direction that said upper body is opened; and body locking means for retaining said upper body in a position where said upper body is closed, wherein a posture of said upper body with respect to said lower body is retained, by said body linking mechanism, approximately the same as a posture of said upper body which is closed, when opening said upper body upward with respect to said lower body, and said upper body is shifted in directions except in a forward direction.

9. A printer device, which includes a paper conveyer path and image formation means for forming an image on a paper conveyed along said paper conveyer path, and which is dividable into an upper body and a lower body, said-printer device comprising:

a body linking mechanism for opening said upper body with a predetermined interval between said lower body, and for connecting said upper body and said lower body, and wherein a posture of said upper body with respect to said lower body is retained by said body linking mechanism, approximately the same as a posture of said upper body which is closed, when opening said upper body upward with respect to said lower body, and said upper body is shifted in directions except in a forward direction, wherein said image formation unit is formed of a drum means, having a photosensitive drum, and a toner unit, having a developing roller; and wherein said drum unit and said toner unit are formed at a predetermined interval in a state where said upper body is opened, and formed in such a way that the photosensitive drum and the developing roller are pressure-contacted in a state where said upper body is closed.

10. A printer device, which includes a paper conveyer path and image formation means for forming an image on a paper conveyed along said paper conveyer path, and which is dividable into an upper body and a lower body, said printer device comprising:

a body linking mechanism for opening said upper body with a predetermined interval between said lower body, and for connecting said upper body and said lower body, wherein a posture of said upper body with respect to said lower body is retained, by said body linking mechanism, approximately the same as a posture of said upper body which is closed, when opening said upper body upward with respect to said lower body and said upper body is shifted in directions except in a forward direction, wherein said image formation means is formed of a plurality of members incorporated with each other, and includes at least one image formation unit, which is detachable from and attachable to said upper body, wherein the image formation unit includes a plurality of image formation units along said paper conveyer path, and wherein each of the plurality of image formation units includes:

a position determination shaft;

a plurality of shaft receivers, which are adjacent to the position determination shafts of the respective image formation units, are arranged in said lower body, when said upper body is shifted back to said lower body so as to be closed; and each of the plurality of shaft receivers has a shaft locking mechanism so as to be locked by an operation of a single lever.

11. The printer device according to claim 10, wherein said shaft locking mechanism:

includes a rotator which rotates along with the operation of the lever, and a rotational member which changes a level of a rotational force of the rotator to a level of a driving force of said shaft receivers; and drives said shaft receivers with the driving force changed by said rotational member, and controls the position determination shafts to lock the shaft receivers, respectively.

12. A printer device comprising a paper path, a print section, a body having upper and lower members, and a linking mechanism which connects said upper and lower members and allows said upper member to move between upper and lower positions, wherein a posture of said upper member with respect to said lower member is retained, by said linking mechanism, approximately the same as a posture of said upper member which is in the lower position, when said upper member is in the upper positions, and wherein said linking mechanism includes:

a pair of first arms each of which has a rotational fulcrum at a central section of either one side surface of said lower member;

a pair of second arms each of which has a rotational fulcrum at an outer section of either one side surface of said lower member; and a pair of link members which are arranged on respective side surfaces of said upper member, and rotatively and oppositely connected to corresponding ones of said respective first and second arms.

13. A printer device comprising a paper path, a print section, a body having upper and lower members, and a linking mechanism which connects said upper and lower members and allows said upper member to move between upper and lower positions, wherein a posture of said upper member with respect to said lower member is retained, by said member linking mechanism, approximately the same as a posture of said upper member which is in the lower position, when said upper member is in the upper position, and wherein said linking mechanism includes:

a link member which links said upper member with said lower member and includes a damper which controls a rotational speed of said upper member, when said upper member is rotated so as to move downward, and which does not operate when said upper member is rotated so as to move upward.

14. A printer device comprising:

a paper path;

a print section;

a body having upper and lower members;

a linking mechanism which connects said upper and lower members and allows said upper member to move between upper and lower positions;

a force provider which forces said upper member upwardly; and a lock which retains said upper member in the lower position.

15. A printer device comprising a paper path, a print section, a body having upper and lower members, and a linking mechanism which connects said upper and lower members and allows said upper member to move between upper and lower positions, wherein:

said print section includes a photosensitive drum, a toner unit and a developing roller; and said drum and said toner unit are formed at a predetermined interval in a state where said upper member is opened, and formed in such a way that the photosensitive drum and the developing roller are pressure-contacted in a state where said upper member is at the lower position.

16. A printer device comprising a paper path, a print section, a body having upper and lower members, and a linking mechanism which connects said upper and lower members and allows said upper member to move between upper and lower positions, wherein:

said print section includes a plurality of image formation units which are detachable from and attachable to said upper member and arranged along said paper conveyer path, each of the plurality of image formation units includes a position determination shaft;

a plurality of shaft receivers, which are adjacent to the position determination shafts of the respective image formation units, are arranged in said lower member, when said upper member is shifted to the lower position; and each of the plurality of shaft receivers has a shaft locking mechanism so as to be locked by an operation of a single lever.

* * * * *